US010145196B2

(12) United States Patent
Redlinger et al.

(10) Patent No.: US 10,145,196 B2
(45) Date of Patent: Dec. 4, 2018

(54) SIGNAL OPERATED DRILLING TOOLS FOR MILLING, DRILLING, AND/OR FISHING OPERATIONS

(71) Applicant: Weatherford Technology Holdings, LLC, Houston, TX (US)

(72) Inventors: Thomas M. Redlinger, Houston, TX (US); Thomas Koithan, Houston, TX (US); Christopher M. Vreeland, Houston, TX (US); Wesley Don Heiskell, Cypress, TX (US); Andrew Antoine, Houston, TX (US); Scott McIntire, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 644 days.

(21) Appl. No.: 14/673,288

(22) Filed: Mar. 30, 2015

(65) Prior Publication Data

US 2015/0211318 A1 Jul. 30, 2015

Related U.S. Application Data

(60) Division of application No. 12/436,077, filed on May 5, 2009, now Pat. No. 8,991,489, which is a (Continued)

(51) Int. Cl.
*E21B 31/113* (2006.01)
*E21B 34/12* (2006.01)
(Continued)

(52) U.S. Cl.
CPC ..... *E21B 31/113* (2013.01); *E21B 4/02* (2013.01); *E21B 7/068* (2013.01); *E21B 17/023* (2013.01);
(Continued)

(58) Field of Classification Search
CPC ..... E21B 31/113; E21B 4/02; E21B 7/068; E21B 17/023; E21B 17/06; E21B 21/103;
(Continued)

(56) References Cited

U.S. PATENT DOCUMENTS 3,222,089 A 12/1965 Otteman
3,223,164 A 12/1965 Otteman
(Continued)

FOREIGN PATENT DOCUMENTS

GB 2294486 A 5/1996
GB 2361727 A 10/2001
(Continued)

OTHER PUBLICATIONS

EPO Partial European Search Report dated Feb. 27, 2017, for European Patent Application No. 14193056.0.
(Continued)

*Primary Examiner* — Wei Wang
(74) *Attorney, Agent, or Firm* — Patterson + Sheridan, LLP

(57) ABSTRACT

A mud motor for use in a wellbore includes: a stator; a rotor, the stator and rotor operable to rotate the rotor in response to fluid pumped between the rotor and the stator; and a lock. The lock is operable to: rotationally couple the rotor to the stator in a locked position, receive an instruction signal from the surface, release the rotor in an unlocked position, and actuate from the locked position to the unlocked position in response to receiving the instruction signal.

20 Claims, 34 Drawing Sheets

Related U.S. Application Data continuation-in-part of application No. 11/842,837, filed on Aug. 21, 2007, now Pat. No. 8,141,634.

(60) Provisional application No. 61/050,511, filed on May 5, 2008, provisional application No. 60/823,028, filed on Aug. 21, 2006.

(51) Int. Cl.

| | |
|---|---|
| ***E21B 29/00*** | (2006.01) |
| ***E21B 47/12*** | (2012.01) |
| ***E21B 7/06*** | (2006.01) |
| ***E21B 17/06*** | (2006.01) |
| ***E21B 21/10*** | (2006.01) |
| ***E21B 23/02*** | (2006.01) |
| ***E21B 23/14*** | (2006.01) |
| ***E21B 43/10*** | (2006.01) |
| ***E21B 31/107*** | (2006.01) |
| ***E21B 17/02*** | (2006.01) |
| ***E21B 31/12*** | (2006.01) |
| ***E21B 47/00*** | (2012.01) |
| ***E21B 47/09*** | (2012.01) |
| ***E21B 4/02*** | (2006.01) |
| ***E21B 23/00*** | (2006.01) |
| ***E21B 29/06*** | (2006.01) |

(52) U.S. Cl.

CPC ..... *E21B 17/06* (2013.01); *E21B 21/103* (2013.01); *E21B 23/00* (2013.01); *E21B 23/02* (2013.01); *E21B 23/14* (2013.01); *E21B 29/005* (2013.01); *E21B 29/06* (2013.01); *E21B 31/107* (2013.01); *E21B 31/12* (2013.01); *E21B 34/12* (2013.01); *E21B 43/108* (2013.01); *E21B 47/00* (2013.01); *E21B 47/09* (2013.01); *E21B 47/12* (2013.01); *E21B 47/122* (2013.01)

(58) Field of Classification Search

CPC ..... E21B 23/00; E21B 23/02; E21B 23/14; E21B 29/005; E21B 29/06; E21B 31/107; E21B 31/12; E21B 34/12; E21B 43/108; E21B 47/00; E21B 47/09; E21B 47/12; E21B 47/122

See application file for complete search history.

(56) References Cited

U.S. PATENT DOCUMENTS

| | | | | |
|---|---|---|---|---|
| 3,321,217 | A | | 5/1967 | Ahlstone |
| 3,344,861 | A | | 10/1967 | Claycomb |
| 3,357,489 | A | | 12/1967 | Brown |
| 3,675,713 | A | | 7/1972 | Watkins |
| 3,842,914 | A | | 10/1974 | Mott |
| 4,109,712 | A | | 8/1978 | Regan |
| 4,153,109 | A | | 5/1979 | Szescila |
| 4,223,920 | A | | 9/1980 | Van Bilderbeek |
| 4,273,372 | A | | 6/1981 | Sheshtawy |
| 4,285,399 | A | | 8/1981 | Holland et al. |
| 4,491,345 | A | | 1/1985 | Regan |
| 4,619,324 | A | | 10/1986 | Couch |
| 4,691,776 | A | | 9/1987 | Pringle |
| 4,705,117 | A | | 11/1987 | Warren et al. |
| 4,856,594 | A | | 8/1989 | Jennings |
| 4,902,044 | A | | 2/1990 | Williams et al. |
| 4,911,243 | A | | 3/1990 | Beynet |
| 4,986,359 | A | | 1/1991 | Cromar et al. |
| 4,993,493 | A | | 2/1991 | Arnold |
| 5,163,514 | A | | 11/1992 | Jennings |
| 5,318,137 | A | * | 6/1994 | Johnson ..... E21B 17/1014 175/325.2 |
| 5,695,009 | A | | 12/1997 | Hipp |
| 5,718,291 | A | | 2/1998 | Lorgen et al. |
| 5,803,182 | A | | 9/1998 | Bakke |
| 5,845,711 | A | | 12/1998 | Connell et al. |
| 5,984,028 | A | | 11/1999 | Wilson |
| 5,984,029 | A | | 11/1999 | Griffin et al. |
| 6,009,948 | A | | 1/2000 | Flanders et al. |
| 6,021,095 | A | | 2/2000 | Tubel et al. |
| 6,029,748 | A | | 2/2000 | Forsyth et al. |
| 6,041,860 | A | | 3/2000 | Nazzal et al. |
| 6,053,262 | A | | 4/2000 | Ferguson et al. |
| 6,164,393 | A | | 12/2000 | Bakke |
| 6,290,004 | B1 | | 9/2001 | Evans |
| 6,333,700 | B1 | | 12/2001 | Thomeer et al. |
| 6,338,504 | B1 | | 1/2002 | Hilliard |
| 6,349,767 | B2 | | 2/2002 | Gissler |
| 6,408,946 | B1 | | 6/2002 | Marshall et al. |
| 6,454,007 | B1 | | 9/2002 | Bailey |
| 6,457,520 | B2 | | 10/2002 | Mackenzie et al. |
| 6,536,524 | B1 | | 3/2003 | Snider |
| 6,712,146 | B2 | | 3/2004 | Estep et al. |
| 6,736,210 | B2 | | 5/2004 | Hosie et al. |
| 6,989,764 | B2 | | 1/2006 | Thomeer et al. |
| 7,083,209 | B2 | | 8/2006 | Leman et al. |
| 7,100,696 | B2 | | 9/2006 | Marshall |
| 7,152,674 | B2 | | 12/2006 | Bowles |
| 7,163,058 | B2 | | 1/2007 | Bakke et al. |
| 7,165,612 | B2 | | 1/2007 | McLaughlin |
| 7,216,699 | B2 | | 5/2007 | Nelson et al. |
| 7,252,152 | B2 | | 8/2007 | LoGiudice et al. |
| 7,762,330 | B2 | | 7/2010 | Saylor, III et al. |
| 9,115,573 | B2 | * | 8/2015 | Purkis ..... E21B 34/14 |
| 2001/0054969 | A1 | | 12/2001 | Thomeer et al. |
| 2002/0046834 | A1 | | 4/2002 | Rayssiguier et al. |
| 2003/0070842 | A1 | | 4/2003 | Bailey et al. |
| 2004/0040707 | A1 | | 3/2004 | Dusterhoft et al. |
| 2004/0251027 | A1 | | 12/2004 | Sonnier et al. |
| 2005/0072565 | A1 | | 4/2005 | Segura et al. |
| 2005/0200498 | A1 | | 9/2005 | Gleitman |
| 2006/0000604 | A1 | | 1/2006 | Jenkins et al. |
| 2006/0065408 | A1 | | 3/2006 | Green et al. |
| 2006/0131011 | A1 | | 6/2006 | Lynde et al. |
| 2007/0000664 | A1 | | 1/2007 | Ring et al. |
| 2007/0251687 | A1 | | 11/2007 | Martinez et al. |
| 2007/0251701 | A1 | | 11/2007 | Jahn et al. |
| 2007/0285275 | A1 | | 12/2007 | Purkis et al. |
| 2008/0041587 | A1 | | 2/2008 | Bell et al. |
| 2008/0041597 | A1 | | 2/2008 | Fisher et al. |
| 2008/0128169 | A1 | | 6/2008 | Radford et al. |
| 2009/0090508 | A1 | | 4/2009 | Brouse |
| 2009/0194285 | A1 | | 8/2009 | Redlinger et al. |
| 2010/0025047 | A1 | | 2/2010 | Sokol et al. |
| 2011/0155368 | A1 | | 6/2011 | El-Khazindar |

FOREIGN PATENT DOCUMENTS

| | | | |
|---|---|---|---|
| GB | 2378197 | A | 2/2003 |
| GB | 2394740 | A | 5/2004 |
| WO | 9958809 | A2 | 11/1999 |
| WO | 0024997 | A1 | 5/2000 |

OTHER PUBLICATIONS

Australian Examination Report dated Nov. 8, 2017, for Australian Patent Application No. 2015252100.

Canadian Office Action dated Oct. 29, 2015 for Application No. 2,871,928.

Australian Patent Examination Report dated Nov. 17, 2016, for Australian Patent Application No. 2015252100.

Fraley, Karen et al.—"RFID Technology for Downhole Well Applications," Exploration and Production—Oil & Gas Review 2007—OTC Edition, pp. 60-62.

Snider, Philip et al.—"Marathon, partners adapt RFID technology for downhole drilling, completion applications," Drilling Contractor, Mar./Apr. 2007, pp. 40 and 42.

Snider, Philip M. et al.—"RFID Downhole Tools and Development for the Drilling Environment," American Association of Drilling Engineers 2009 National Technical Conference & Exhibition, New Orleans, Louisiana, AADE 2009NTCE-16-04 Tech Paper, pp. 1-3.

(56) References Cited

OTHER PUBLICATIONS

EPO Extended European Search Report dated Jun. 19, 2017, for European Application No. 14193056.0.
EPO Office Action dated Mar. 16, 2018, for European Patent Application No. 14193056.0.

* cited by examiner

SIGNAL OPERATED DRILLING TOOLS FOR MILLING, DRILLING, AND/OR FISHING OPERATIONS

BACKGROUND OF THE INVENTION

Field of the Invention

Embodiments of the present invention generally relate to signal operated tools for milling, drilling, and/or fishing operations.

Description of the Related Art

In wellbore construction and completion operations, a wellbore is initially formed to access hydrocarbon-bearing formations (i.e., crude oil and/or natural gas) by the use of drilling. Drilling is accomplished by utilizing a drill bit that is mounted on the end of a drill support member, commonly known as a drill string. To drill within the wellbore to a predetermined depth, the drill string is often rotated by a top drive or rotary table on a surface platform or rig, or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annular area with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Historically, oil field wells have been drilled as a vertical shaft to a subterranean producing zone forming a wellbore. The casing is perforated to allow production fluid to flow into the casing and up to the surface of the well. In recent years, oil field technology has increasingly used sidetracking or directional drilling to further exploit the resources of productive zones. In sidetracking, an exit, such as a slot or window, is cut in a steel cased wellbore typically using a mill, where drilling is continued through the exit at angles to the vertical wellbore. In directional drilling, a wellbore is cut in strata at an angle to the vertical shaft typically using a drill bit. The mill and the drill bit are rotary cutting tools having cutting blades or surfaces typically disposed about the tool periphery and in some models on the tool end.

SUMMARY OF THE INVENTION

Embodiments of the present invention generally relate to signal operated tools for milling, drilling, and/or fishing operations. In one embodiment, a mud motor for use in a wellbore includes: a stator; a rotor, the stator and rotor operable to rotate the rotor in response to fluid pumped between the rotor and the stator; and a lock. The lock is operable to: rotationally couple the rotor to the stator in a locked position, receive an instruction signal from the surface, release the rotor in an unlocked position, and actuate from the locked position to the unlocked position in response to receiving the instruction signal.

In another embodiment, a setting tool for setting an anchor includes a tubular housing having a port formed through a wall thereof; a piston disposed in the housing and operable to inject fluid through the port; and an actuator. The actuator is operable: to receive an instruction signal from the surface, and to drive the piston in response to receiving the instruction signal.

In another embodiment, a method of forming an opening in a wall of a wellbore includes deploying a drill string and a bottom hole assembly (BHA) into the wellbore. The BHA includes a bit, mud motor, an orientation sensor, a setting tool, a whipstock, and an anchor. The method further includes orienting the whipstock while injecting drilling fluid through the motor sufficient to operate the orientation sensor. The motor is in a locked position. The method further includes sending an instruction signal to the setting tool, thereby setting the anchor.

In another embodiment, a data sub for use in a wellbore includes a tubular housing having a bore formed therethrough; one or more sensors disposed in the housing; and a transmitter disposed in the housing and operable to transmit a measurement from the sensor to the surface.

In another embodiment, a method of transmitting data from a depth in a wellbore distal from the surface to the surface includes: measuring a parameter using a data sub interconnected in a tubular string disposed in the wellbore. The data sub is at the distal depth. The method further includes transmitting the measurement from the data sub to a repeater sub interconnected in the tubular string. The repeater sub is at a depth between the distal depth and the surface. The method further includes retransmitting the measurement from the repeater sub to the surface.

In another embodiment, a jar for use in a wellbore includes: a tubular mandrel; a tubular housing; a fluid chamber formed between the housing and the mandrel; a piston operable to increase pressure in the chamber in response to longitudinal displacement of the mandrel relative to the housing; a valve operable to open the chamber in response to a predetermined longitudinal displacement of the mandrel relative to the housing; and a lock. The lock is operable to: longitudinally couple the mandrel to the housing in a locked position, receive an instruction signal from the surface, release the mandrel in an unlocked position, and actuate from the locked position to the unlocked position in response to receiving the instruction signal.

In another embodiment, a jar for use in a wellbore includes: a tubular mandrel; a tubular housing; and a valve. The valve is: longitudinally coupled to the mandrel, operable to at least substantially restrict fluid flow through the jar in a closed position, thereby exerting tension on the mandrel, and operable to open in response to a predetermined longitudinal displacement of the mandrel relative to the housing. The jar further includes a lock operable to: longitudinally couple the mandrel to the housing in a locked position, receive an instruction signal from the surface, release the mandrel in an unlocked position, and actuate from the locked position to the unlocked position in response to receiving the instruction signal.

In another embodiment, a fishing tool for engaging a tubular stuck in a wellbore includes: a tubular housing having an inclined surface; a grapple having an inclined surface longitudinally movable along the inclined surface of the housing, thereby radially moving the grapple between a retracted position and an engaged position; and an actuator. The actuator is operable to: longitudinally restrain the grapple in the released position, receive an instruction signal from the surface, and longitudinally move the grapple from the released position to the engaged position in response to receiving the instruction signal.

In another embodiment, a method of freeing a fish stuck in a wellbore includes deploying a fishing assembly into the wellbore. The fishing assembly includes a workstring, a jar, and a fishing tool, and the jar is in a locked position. The method further includes engaging the fishing tool with the fish; sending an instruction signal from the surface to the fishing tool, thereby engaging a grapple of the fishing tool with the fish; sending a second instruction signal from the surface to the jar, thereby unlocking the jar; and firing the jar, thereby exerting an impact on the fish.

In another embodiment, a disconnect tool for use in a string of tubulars includes: a tubular mandrel; a tubular housing; a latch longitudinally coupling the housing and the mandrel; a lock operable to engage the latch in a locked position and disengage from the latch in a released position; and an actuator. The actuator is operable to: receive an instruction signal from the surface, and move the lock to the released position in response to receiving the instruction signal.

In another embodiment, a disconnect tool for use in a string of tubulars includes: a tubular mandrel; a tubular housing; a latch operable to longitudinally couple the housing and the mandrel in an engaged position. The latch is fluidly operable to a disengaged position. The disconnect further includes a valve operable to: receive an instruction signal from the surface, and open in response to receiving the instruction signal, thereby providing fluid communication between a bore of the housing and the latch.

In another embodiment, a disconnect tool for use in a string of tubulars includes: a tubular mandrel having a threaded inner surface; a tubular housing having a plurality of openings formed radially through a wall thereof; an arcuate dog disposed in each opening, each dog having an inclined inner surface and portion of a thread corresponding to the mandrel thread and radially movable between an engaged position and a disengaged position. The thread portion engages the mandrel thread in the engaged position, thereby longitudinally and rotationally coupling the housing and the mandrel. The disconnect further includes a tubular sleeve having an inclined outer surface operable to engage with the inclined inner surface of each dog.

In another embodiment, a method of drilling a wellbore includes: deploying a drilling assembly in the wellbore. The drilling assembly includes a drill string, a disconnect tool, and a drill bit. The method further includes injecting drilling fluid through the drilling assembly and rotating the bit, thereby drilling the wellbore. The method further includes sending an instruction signal from the surface, thereby operating the disconnect tool and releasing the drill bit from the drill string.

In another embodiment, a drilling assembly includes a tubular drill string; a drill bit longitudinally coupled to an end of the drill string; and a plurality of data subs interconnected with the drill string. Each data sub includes a strain gage oriented to measure torque or longitudinal load; and a transmitter.

In another embodiment, a method of determining a freepoint of a drilling assembly stuck in a wellbore, the drilling assembly including a drill string and a plurality of data subs interconnected with the drill string. The method includes: exerting a torque and/or tension on the stuck drilling assembly from the surface; measuring a response of the drilling assembly to the torque and/or tension using the data subs; transmitting the measured response from the data subs to the surface; and determining a freepoint of the drilling assembly using the transmitted response.

In another embodiment, a cutter for use in a wellbore includes: a tubular housing having one or more openings formed through a wall thereof; one or more blades, each blade pivoted to the housing and rotatable relative thereto between an extended position and a retracted position. Each blade extends through the opening in the extended position. The cutter further includes a piston operable to move the blades to the extended position in response to injection of fluid therethrough; and a stop. The stop is operable: receive a position signal from the surface, and move to a set position in response to the signal.

In another embodiment, a cutter for use in a wellbore includes: a tubular housing having a one or more openings formed through a wall thereof; one or more blades, each blade pivoted to the housing and rotatable relative thereto between an extended position and a retracted position. Each blade extends through a respective opening in the extended position. The cutter further includes a mandrel operable to move the blades to the extended position; and an actuator. The actuator is operable to: receive a position signal from the surface, and move the mandrel to a set position in response to the position signal, thereby at least partially extending the blades.

In another embodiment, a method of cutting or milling a tubular cemented to the wellbore includes deploying a cutting assembly into the wellbore. The cutting assembly includes a workstring and a cutter. The method further includes sending an instruction signal to the cutter, thereby extending one or more blades of the cutter; and rotating the cutter, thereby milling or cutting the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
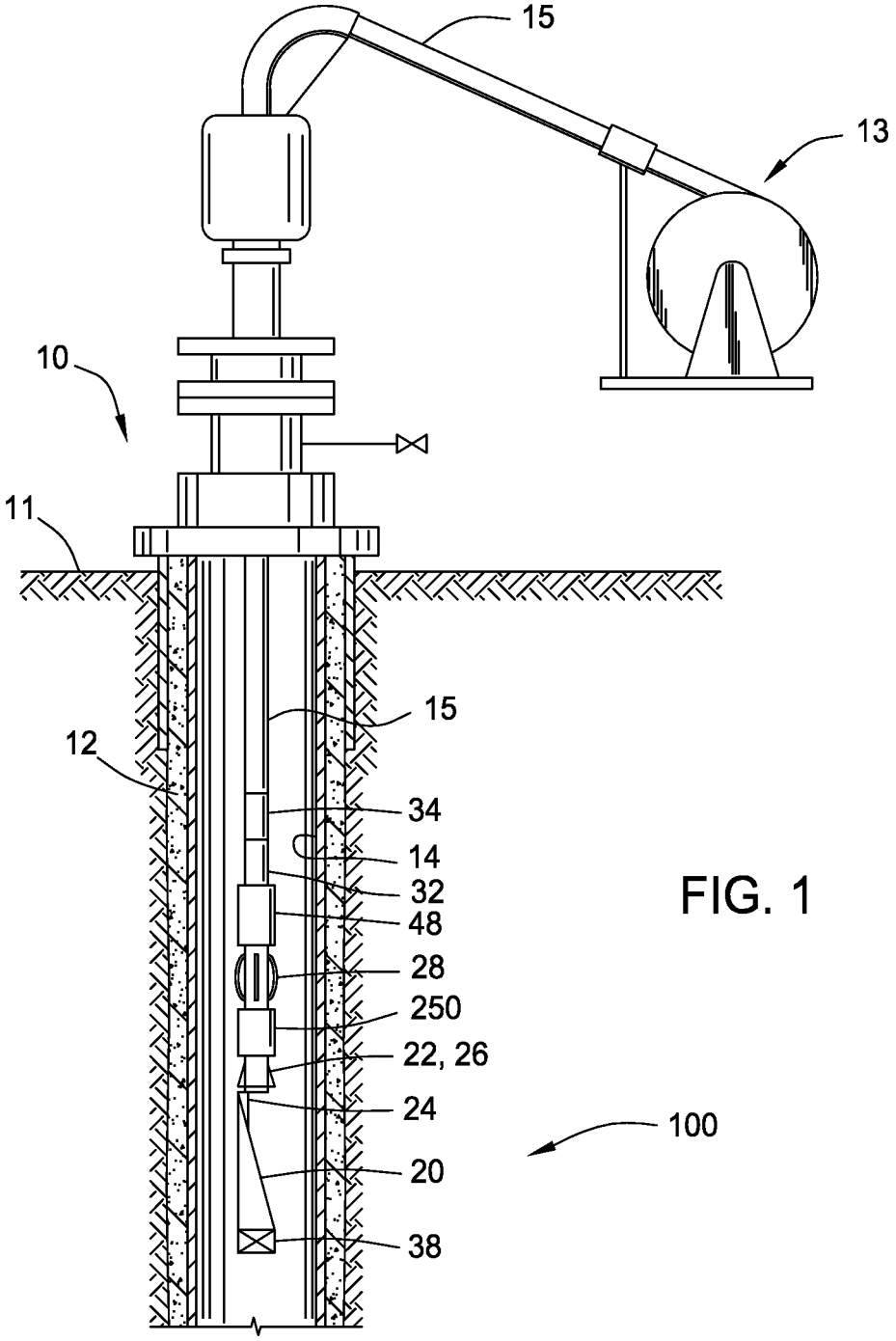
FIG. 1 is a schematic cross sectional view of a drill string and bottomhole assembly (BHA), according to one embodiment of the present invention.

FIG. 1 is a schematic cross sectional view of a drill string 15 and bottomhole assembly (BHA) 100, according to one embodiment of the present invention. The wellbore 10 is drilled through a surface 11 of the earth to establish a wellbore 10. The wellbore 10 may be cased with a casing 14. The casing 14 may be cemented 12 into the wellbore 10. A reel 13 is disposed adjacent the wellbore 10 and contains a quantity of tubing, such as coiled tubing 15. Alternatively, the drill string 15 may be joints of drill pipe connected with threaded connections. The coiled tubing 15 typically does not rotate to a significant degree within the wellbore.

The BHA 100 may be longitudinally and rotationally coupled to the coiled tubing 15, such as with a threaded or flanged connection. Various components can be coupled to the coiled tubing 15 as described below beginning at the lower end of the arrangement. The BHA 100 may include an orienter 34, a measurement while drilling tool (MWD) 32, a mud motor 48, a stabilizer 28, a setting tool 250, a spacer mill 26, and a lead mill 22, a whipstock 20, and an anchor 38. Each of the BHA components longitudinally and rotationally coupled, such as with a threaded or flanged connection.

The anchor 38 may be a bridge plug or packer and may be selectively expanded by operation of the setting tool 250. The whipstock 20 may include an elongated tapered surface that guides the bit 22, outwardly toward casing 14. The whipstock 20 may be longitudinally and rotationally coupled to the lead mill 22 by one or more frangible members, such as shear screws 24. The spacer mill 26 may be operable to further define the hole or exit created by the lead mill. Alternatively, a hybrid mill/drill bit capable of milling an exit and continuing to drill into the formation may be used instead of the lead mill. An exemplary hybrid bit is disclosed in U.S. Pat. No. 5,887,668 and is incorporated by reference herein. The stabilizer 28 may have extensions protruding from the exterior surface to assist in concentrically retaining the BHA 100 and in the wellbore 10. The motor 48 may be operated by injection of drilling fluid, such as mud, therethrough to rotate the mills 22, 26 while the coiled tubing 15 remains relatively rotationally stationary.

As discussed below, the motor 48 may be selectively operable. The MWD 32 also be operated by the injection of drilling mud therethrough to provide feedback to equipment located at the surface 11, such as by pulsing the flow of the mud. The orienter 34 may be operable to incrementally angular rotate the whipstock 20 in a certain direction. The orienter 34 may be operated by starting injection of drilling mud therethrough and stopping mud injection after a predetermined increment of time. Each pulse of mud indexes the orienter a predetermined increment, such as 15-30 degrees. Thus, the orienter 34 can rotate the arrangement containing the whipstock to a desired orientation within the wellbore, while the position measuring member 32 provides feedback to determine the orientation. Alternatively, if drill pipe is used instead of coiled tubing, the whipstock may be oriented by rotating the drill string or using the orienter, thereby making the orienter optional.

The motor 48 allows flow without substantial rotation at a first flow rate and/or pressure to allow sufficient flow through the orienter 34 and the position measuring member 32 without actuation of the motor. The flow in the tubing member through the orienter, position measuring member and motor is then exhausted through ports in the end mill and flows outwardly and then upwardly through the wellbore 10 back to the surface 11. Flow through or around the motor 48 allows the reduction of at least one trip in setting the anchor 18 and starting to drill the exit in the wellbore 10.

Figure 2A:
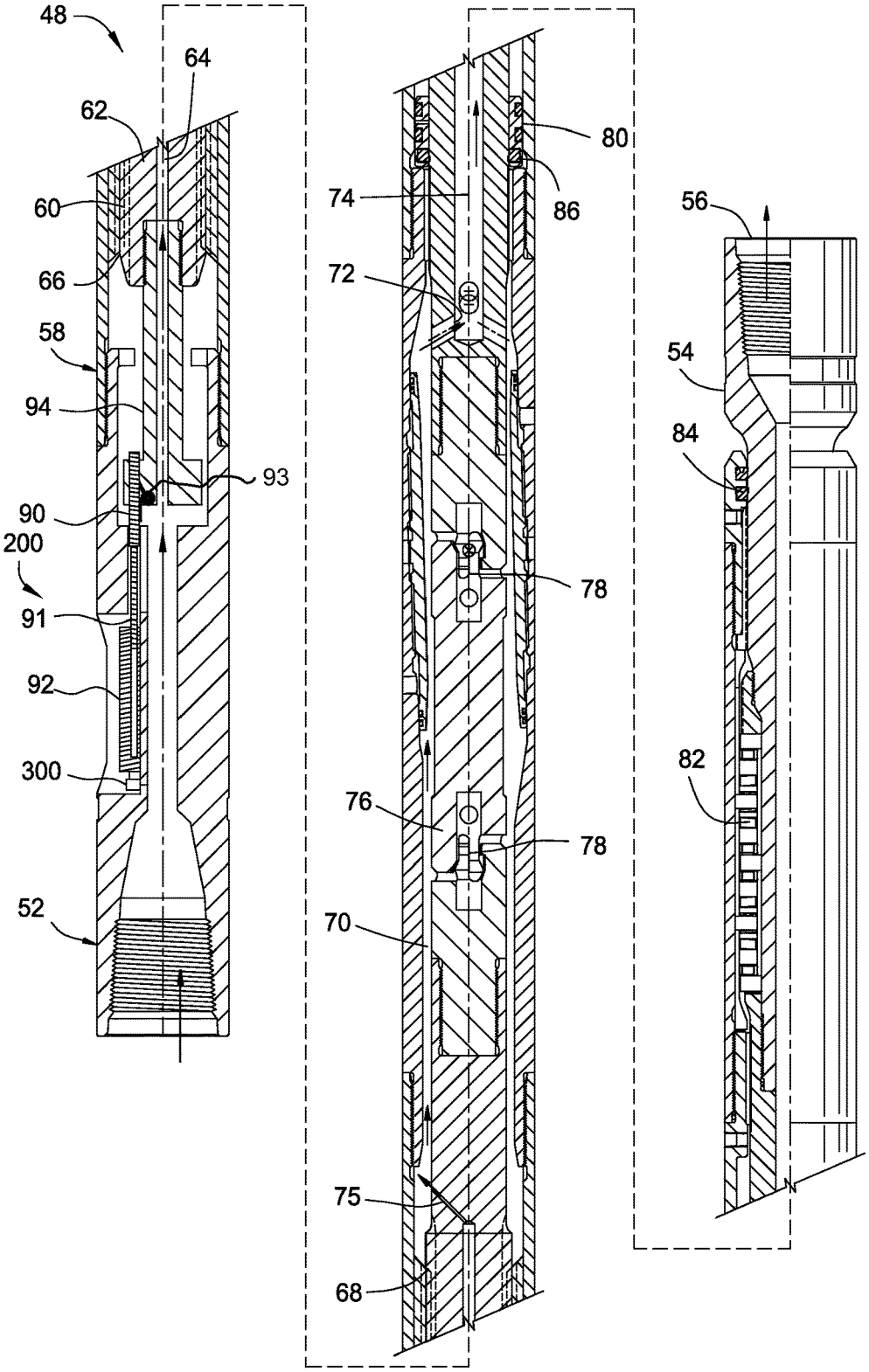
FIG. 2A is a cross sectional view of a motor of the BHA.
Figure 2B:
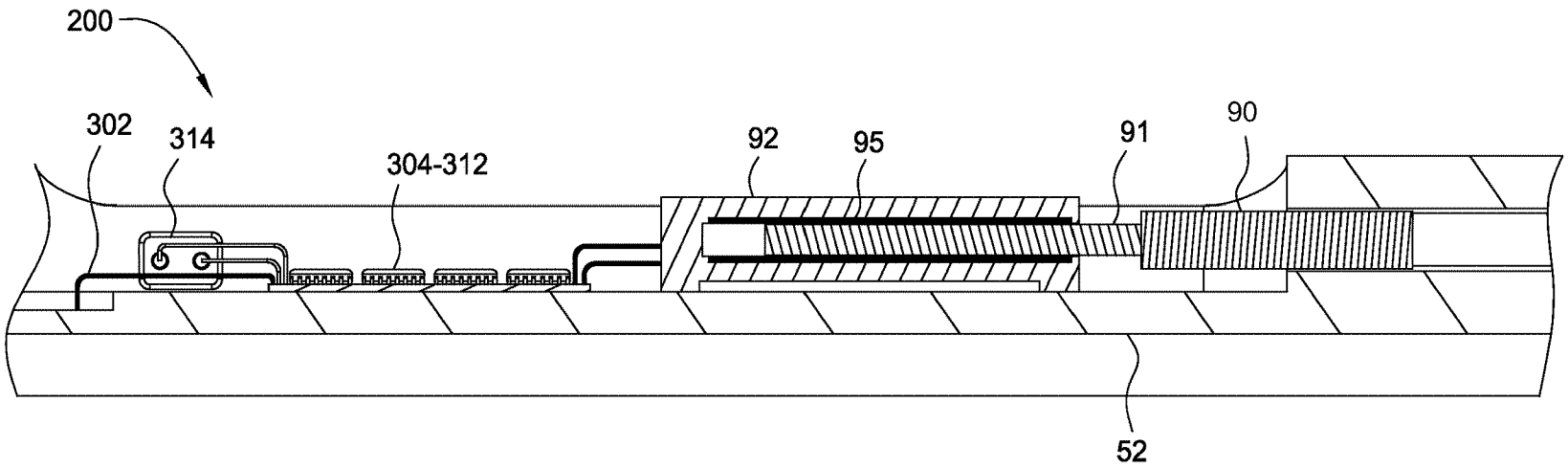
FIG. 2B is a cross section of a lock of the motor in the unlocked position.

FIG. 2A is a cross sectional view of the motor 48. FIG. 2B is a cross section of the lock 200 in the unlocked position. The motor 48 may be a progressive cavity motor and include a top sub 50 having a fluid inlet 52, an output shaft 54 having a fluid outlet 56, and a power section 58 disposed therebetween. The power section 58 may include a stator 60 circumferentially disposed about a rotor 62. The rotor 62 may have a hollow bypass 64 disposed therethrough that is fluidly coupled from the inlet 52 to the outlet 56. An inlet 66 of the power section 58 of the motor 48 may allow fluid to flow into a progressive cavity created between the stator 60 and the rotor 62 as the rotor rotates about the stator and to exit an outlet 68 of the power section.

The stator 60 may include a housing and an elastomeric member molded thereto. An outer surface of the rotor 62 may form a plurality of lobes extending helically along the rotor. An inner surface of the stator may form a plurality of lobes extending helically along the stator. The number of stator lobes may be one more than the number of rotor lobes. The stator may be conventional or even-walled. A conventional stator may have the lobes formed by the elastomeric member and an even-walled stator may have the lobes formed by the housing and the elastomeric member, resulting in a thinner elastomeric member than the conventional stator. Fluid flowing from the inlet through the power section may drive the rotor to rotate and precess, thereby forming a progressive cavity that progresses from the inlet to the outlet as the rotor rotates.

An annulus 70 downstream of the outlet 68 is created between the inner wall of the motor 48 and various components disposed therein, which provide a flow path for the fluid exiting the outlet 68. A transfer port 72 is fluidly coupled from the annulus 70 to a hole 74 disposed in the output shaft 54 and then to the output 56. A restrictive port 75 can be formed between the hollow cavity 64 and the annulus 70 to fluidly couple the hollow cavity 64 to the annulus 70.

Because the rotor precesses within the stator, an articulating shaft 76 may be disposed between the rotor 62 and the output shaft 54, so that the output shaft 54 can rotate circumferentially within the motor 48. The articulating shaft 76 can include one or more knuckle joints 78 that allow the rotor to precess within the stator with the necessary degrees of freedom. A bearing 80 can be disposed on an upper end of an output shaft 54 and a lower bearing assembly 82 can be disposed on a lower end of an output shaft 54. One or more seals, such as seals 84, 86, assist in sealing fluid from leaking through various joints in the downhole motor 48.

As discussed above, the motor 48 may be selectively operated. The motor 48 may further include a lock 200 disposed in a chamber formed in the top sub 52. The chamber may be sealed (not shown) from the wellbore and a bore of the top sub 52. The lock 200 may include a key 90, a shaft 91, and an actuator, such as a solenoid 92. The key 90 and shaft 91 may be rotationally coupled to the top sub 52. A stem 94 may be longitudinally and rotationally coupled to the rotor 62, such as by a threaded connection. The lock 200 may be operable between a locked position and an unlocked position. The key 90 may be received by a keyway formed through a head of the stem. Engagement of the key 90 with the keyway may rotationally couple the rotor 62 to the top sub 52, thereby preventing operation of the motor 48. A valve, such as a flapper 93, may be longitudinally coupled to the stem 94. The flapper 93 may be biased toward a closed position, such as by a torsion spring, where the flapper 93 may cover a top of the bypass 64, thereby preventing fluid flow from the top sub bore into the bypass. The flapper 93 may be held in the open position by engagement of the key 90 with an arm rotationally coupled to the flapper 93. Disengagement of the key 90 from the keyway may release the rotor 62 and the flapper 93, thereby allowing the motor 48 to operate and sealing the bypass 64.

Alternatively, the flapper and the bypass may be omitted. In this alternative, leakage through the mud motor may supply the necessary fluid flow to allow operation of the orienter 34 and the MWD tool 32.

Figure 3A:
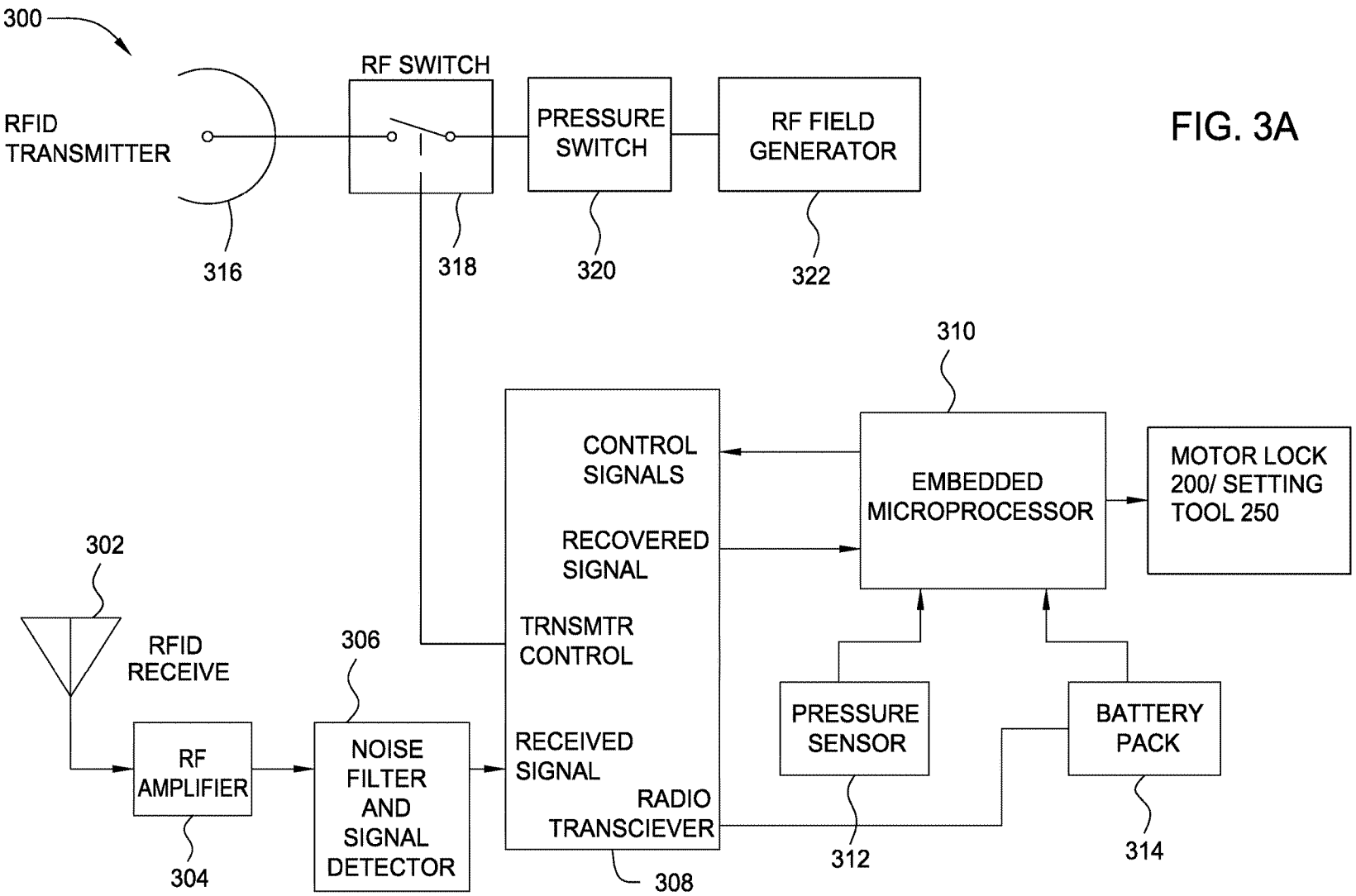
FIG. 3A illustrates a radio-frequency identification (RFID) electronics package.
Figure 3B:
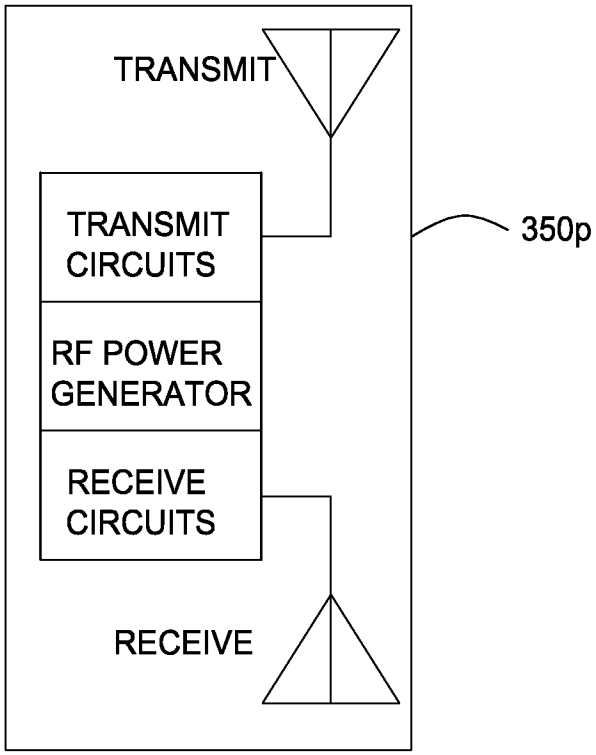
FIG. 3B illustrates an active RFID tag and a passive RFID tag.
Figure 3B:
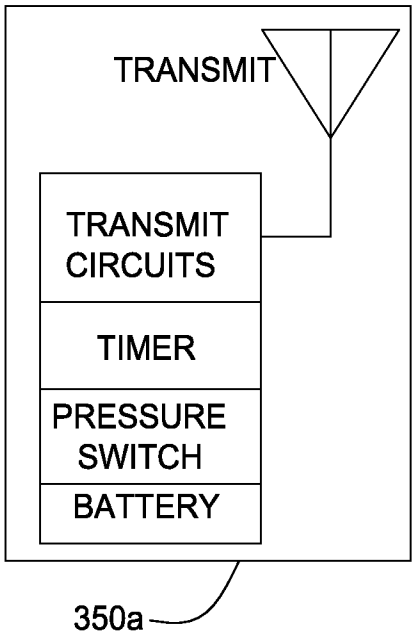

FIG. 3A illustrates a radio-frequency identification (RFID) electronics package 300. FIG. 3B illustrates an active RFID tag 350*a* and a passive RFID tag 350*p*. The lock 200 may further include the electronics package 300. The electronics package 300 may communicate with a passive RFID tag 350*p* or an active RFID tag 350*a*. Either of the RFID tags 350*a,p* may be individually encased and dropped or pumped through the coiled tubing string. Alternatively, either of the RFID tags may be embedded in a ball (not shown) for seating in a ball seat of a tool, a plug, bar or some other device used to initiate action of a downhole tool.

The RFID electronics package 300 may include a receiver 302, an amplifier 304, a filter and detector 306, a transceiver 308, a microprocessor 310, a pressure sensor 312, battery pack 314, a transmitter 316, an RF switch 318, a pressure switch 320, and an RF field generator 322. If the active RFID tag 350*a* is used, the components 316-322 may be omitted.

If a passive tag 350*p* is used, once the motor lock 200 is deployed to a sufficient depth in the wellbore, the pressure switch 320 may close. The pressure switch 320 may remain open at the surface to prevent the electronics package 300 from becoming an ignition source. The microprocessor may also detect deployment in the wellbore using pressure sensor 312. The microprocessor 310 may delay activation of the transmitter for a predetermined period of time to conserve the battery pack 314. The microprocessor may then begin transmitting a signal and listening for a response. Once the tag 350*p* is deployed into proximity of the transmitter 316, the passive tag 350*p* may receive the signal, convert the signal to electricity, and transmit a response signal. The electronics package 300 may receive the response signal, amplify, filter, demodulate, and analyze the signal. If the signal matches a predetermined instruction signal, then the microprocessor 310 may activate the motor lock 200.

If the active tag 350*a* is used, then the tag 350*a* may include its own battery, pressure switch, and timer so that the tag 350*a* may perform the function of the components 316-322.

Further, either of the tags 350*a,p* may include a memory unit (not shown) so that the microprocessor may send a signal to the tag and the tag may record the signal. The signal may then be read at the surface 11. The signal may be confirmation that a previous action was carried out or a measurement by a sensor, such as pressure, temperature, torque, and/or longitudinal load.

Alternatively, instead of RFID, the electronics package 300 may be configured to receive mud pulses from the surface. Alternatively, instead of RFID, the electronics package may include an electromagnetic (EM) receiver or transceiver (not shown) or an acoustic receiver or transceiver. An EM telemetry system is discussed in U.S. Pat. No. 6,736,210, which is hereby incorporated by reference in its entirety.

Returning to FIGS. 2A and 2B, once the microprocessor 310 detects the one of the RFID tags 350*a,p* with the correct instruction signal, the microprocessor 310 may supply electricity from the battery 314 to the solenoid 92, thereby longitudinally retracting the shaft 91 and the key 93 from the stem 94 and allowing operation of the motor 48 and closing of the bypass 64.

The motor lock 200 may further include a position sensor 95, such as a coil of wire wound around an inner surface of the solenoid 92. The position sensor 95 may be operable to detect a position of the shaft 91 to determine if the key has seated or unseated in to/from the keyway. The coil 95 may determine the position of the shaft 91 via electromagnetic communication with the shaft. Alternatively, a proximity switch may be used instead of the position sensor 95. The position sensor 95 may be in communication with the microprocessor 310 so that the microprocessor may monitor the position of the shaft 91, thereby knowing when to cease supplying electricity to the solenoid. The lock 200 may further include a mechanical latch (not shown) to retain the shaft and key in the unlocked position. For the limit switch alternative, the limit switch may be incorporated into the mechanical latch. When actuating the key between the positions, the microprocessor may utilize the position sensor 95 to conserve battery life by supplying electricity at a first power level to the solenoid to determine if the shaft moves. If the shaft does not move, the microprocessor may then supply electricity to the solenoid at a second increased power level and so on until the shaft moves. Further, once the instruction signal has been sent, the surface may send a second tag including a memory unit that requests a status report from the microprocessor, such as confirmation that the motor has been successfully unlocked, what power level was required to unlock the motor, an error log if the motor was not successfully unlocked, and/or a charge level of the battery. The microprocessor may encode the requested data to the tag using the transmitter 316. The tag may return to surface via an annulus formed between the drill string and the casing.

Figure 2C:
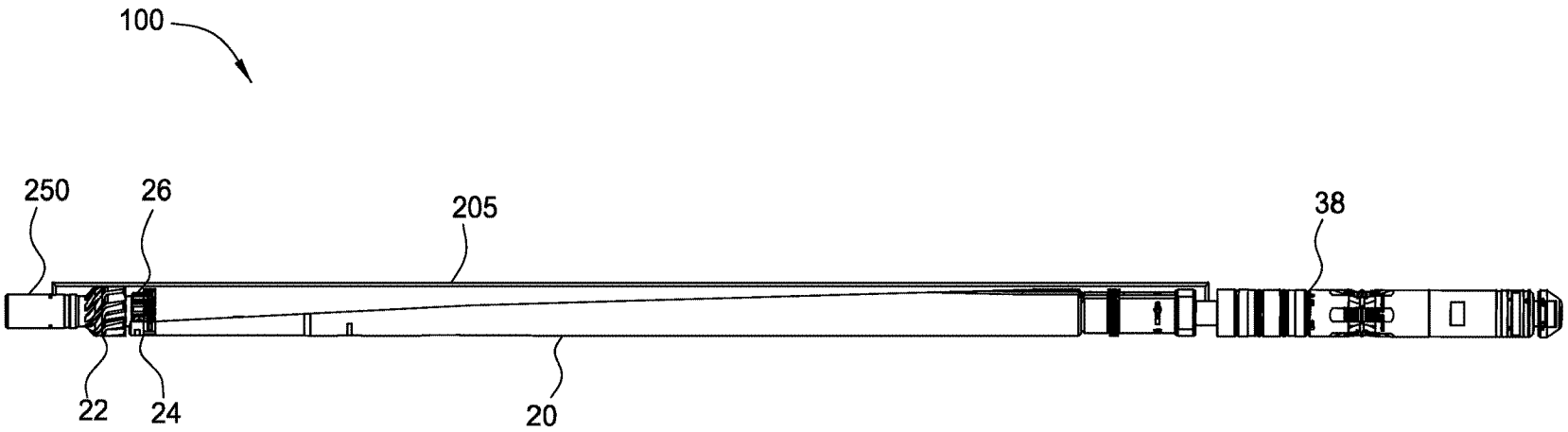
FIG. 2C is a detailed side view of a portion of the BHA.

FIG. 2C is a detailed side view of a portion of the BHA 100. The setting tool 250 may be in fluid communication with the anchor 38 via a control line 205. The anchor 38 may be retrievable after it is set or made from a drillable material. The anchor 38 may include a mandrel, a piston, slips, a packing element, and a cone. Fluid pressure supplied to the piston from the setting 250 tool may drive the piston longitudinally along the mandrel, thereby compressing the packing element radially outward against the casing and pushing the slips over the cone (or vice versa), thereby radially moving the slips outward against the casing. The whipstock 20 may be releasably connected to the anchor 38 so that the whipstock may be retrieved.

Figure 2D:
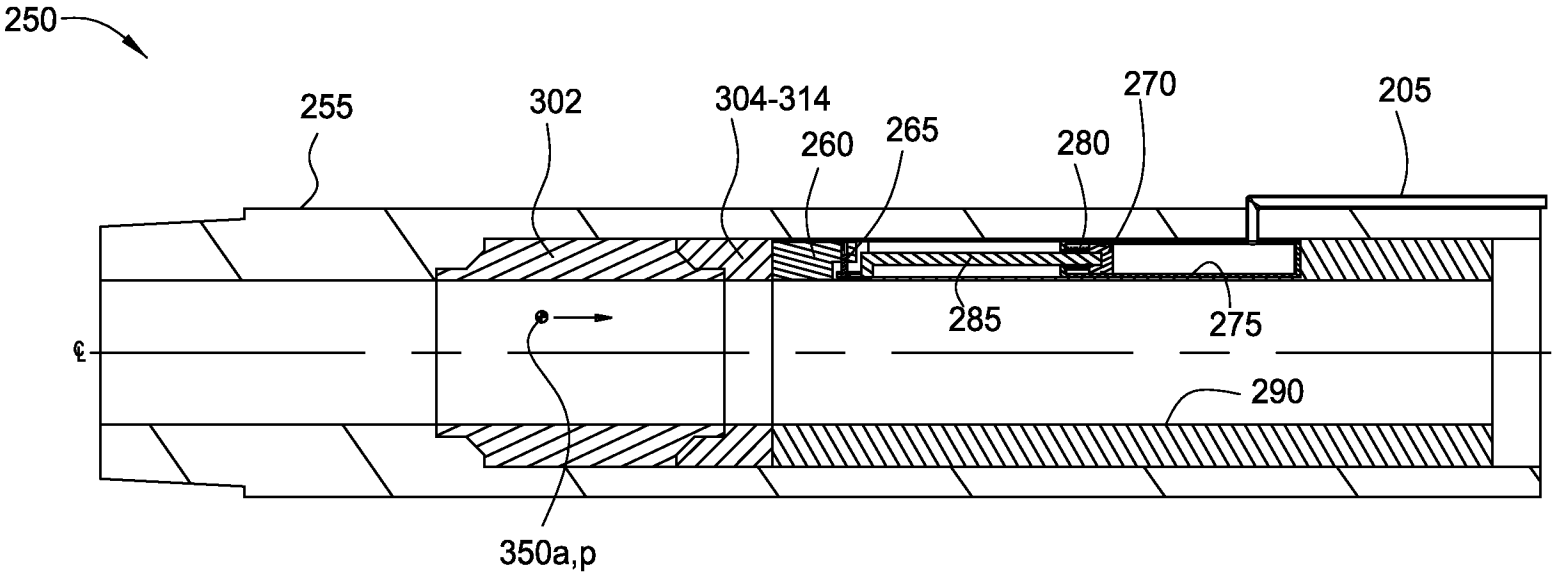
FIG. 2D is a cross section of a setting tool of the BHA.

FIG. 2D is a cross section of the setting tool 250. The setting tool may include a housing 255, an actuator 260, a trigger 265, a piston 270, a cylinder 275, a biasing member, such as a spring 280, a rod 285, a sleeve 290, and the electronics package 300. The housing 255 may be tubular and include threaded couplings formed at each longitudinal end thereof. The sleeve 290 may be disposed in the housing 255 and longitudinally and rotationally coupled thereto. The sleeve 290 may house the actuator 260, the rod 285, the piston 270, the spring 280, and the cylinder 275. The sleeve 290, the cylinder 275, and the housing 255 may each have a flow port formed therethrough providing fluid communication between the cylinder 275 and the control line 205. The cylinder 275 may be filled up to the piston 270 with a hydraulic fluid, such as oil. The piston 270 may be housed in the cylinder, biased toward a lower end of the cylinder 275 by the spring 280.

The rod 285 may be longitudinally coupled to the cylinder 275, such as by a threaded connection. The rod 285 may be longitudinally restrained by a trigger 265. The actuator 260 may include a solenoid for radially moving the trigger 265. The actuator 260 may be longitudinally coupled to the sleeve 290. In operation, when it is desired to set the anchor 38, one of the tags 350*a,p* may be dropped or pumped through a bore of the housing 255 and the sleeve 290. The electronics package 300 may detect an instruction signal from the tag 350*a,p*. The microprocessor 310 may then supply electricity to the actuator 260, thereby radially moving the trigger 265 outward and releasing the rod. The spring 280 may then push the piston 270 and the rod 285 toward the lower end of the cylinder 275, thereby driving the anchor piston via the hydraulic fluid.

Alternatively, a pump may replace the piston and cylinder. Alternatively, instead of a spring, an upper end of the piston may be exposed to wellbore pressure or a pressurized gas chamber, such as nitrogen.

Figure 4A:
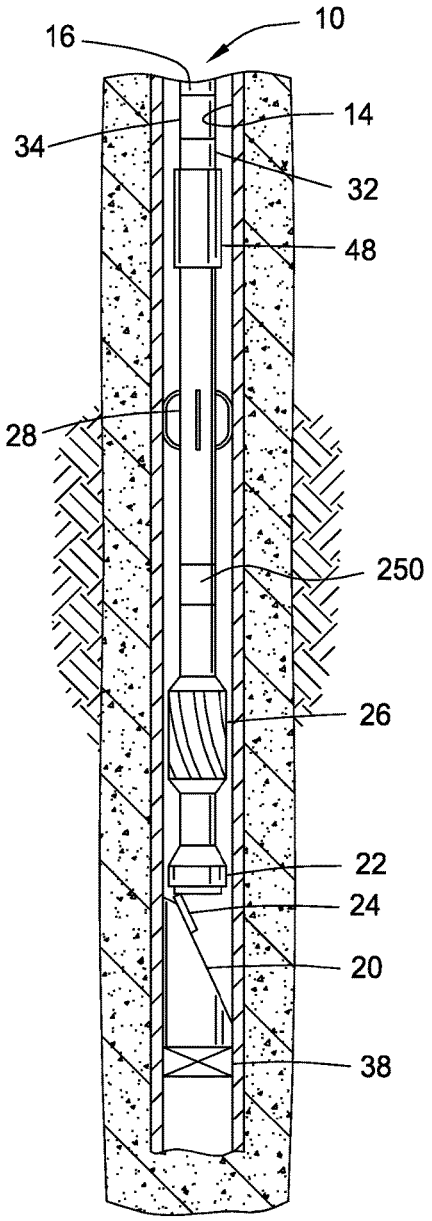
FIG. 4A illustrates the BHA after the anchor is set with the whipstock in the proper orientation.

FIG. 4A illustrates the BHA 100 after the anchor 38 is set with the whipstock 20 in the proper orientation. In operation, mud may be pumped down the coiled tubing 15 and into inlet 52 of the top sub 50. The mud flow may continue into the bypass 64 in the rotor 62 and through port 75, into the annulus 70, and eventually through the output 56 of the output shaft 54. The mud flow may exit the BHA 100 via ports formed through the mill 22. The flow through the bypass 64 may provide the necessary flow rate to operate the orienter 34 and the MWD tool 32. Once the whipstock 20 is oriented, an RFID tag 350*a,p* may be dropped/pumped through the coiled tubing to the setting tool electronics package. The tag 350*a,p* may include the appropriate instruction signal for the setting tool 250 to operate. The setting tool 250 may receive the instruction signal from the tag 350*a,p* and set the anchor 38.

Figure 4B:
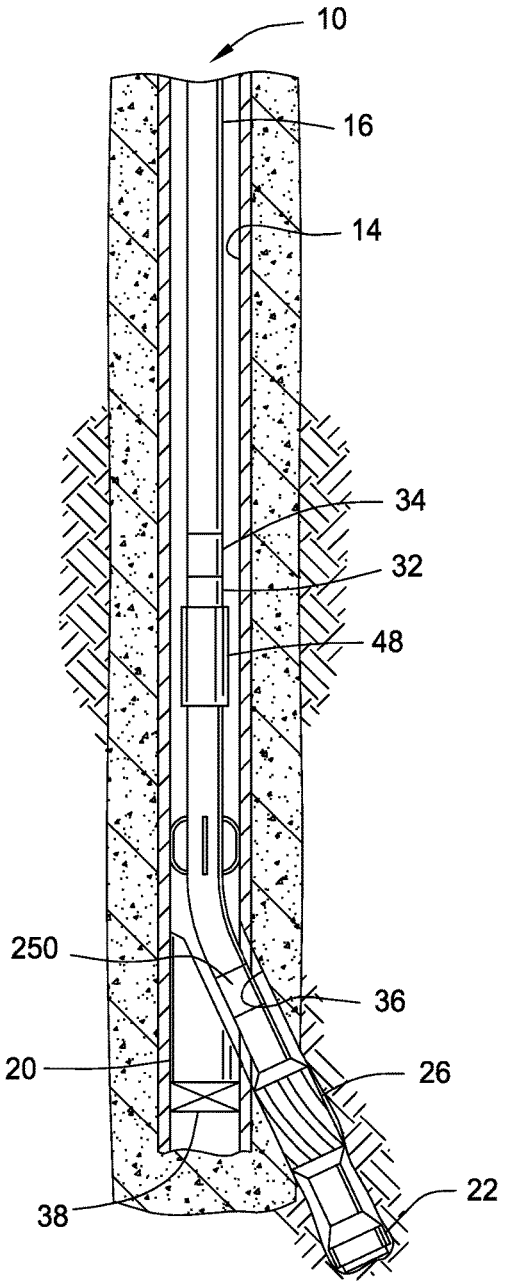
FIG. 4B illustrates the mills cutting a window through the casing.

FIG. 4B illustrates the mills cutting a window 36 through the casing 14. Since the tags may be encoded with unique signals, a second tag 350*a,p* may then be dropped to generate a second signal for the motor lock 200. Alternatively, the motor lock 200 may also receive the setting tool instruction signal and delay operation for a predetermined period of time sufficient for the setting tool to set the anchor. The motor lock 200 may then unlock the motor and close the bypass 64. The motor 48 may then exert torque on the mill assembly, thereby shearing the screws 24 and the control line 205 and releasing the whipstock 20. Alternatively, the screws 24 may be sheared before unlocking the motor by setting weight of the drill string down on to the BHA 100 from the surface, thereby also testing for setting of the anchor. The BHA 100 may then be lowered and the whipstock 20 may guide the rotating mills 22,26 into engagement with the casing 14. The mills 22,26 may then form the window 36.

Alternatively, the motor 48 may be used as a backup motor to a primary drilling motor in a drill string. The motor 48 may remain locked if and until the primary motor fails. A tag 350*a,p* may then be dropped unlocking the motor 48 and drilling may be continued without tripping the drill string to replace the primary motor. Alternatively, the motor 48 may be disposed in a directional drill string including a bit motor, a drill bit, and a bent sub. The bit motor may rotate the drill bit and the motor 48 may selectively rotate the bent sub, the drill bit, and the bit motor to switch between rotary and slide drilling.

Alternatively, the motor lock 200 may be used with a conventionally set anchor 38. Alternatively, the setting tool 250 may be used with a conventional mud motor and an alternative MWD tool which utilizes electromagnetic telemetry to communicate to the surface. Alternatively, the setting tool 250 may be used with a shear-pin locked motor or a motor with a choked bypass and the mud operated MWD tool 32.

Figure 5:
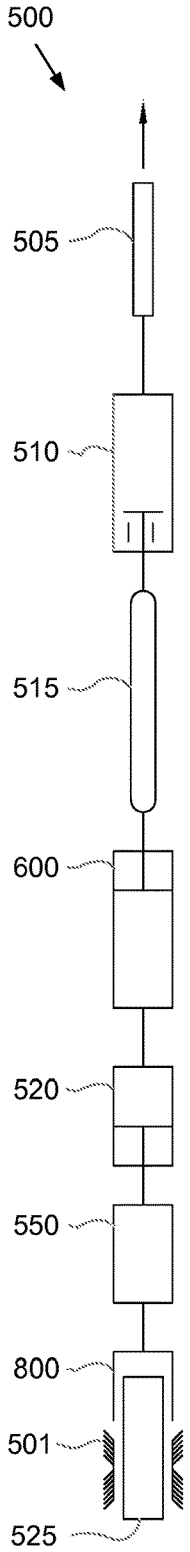
FIG. 5 is a schematic of a fishing assembly deployed in a wellbore to retrieve a fish stuck in the wellbore, according to another embodiment of the present invention.

FIG. 5 is a schematic of a fishing assembly 500 deployed in a wellbore 501 to retrieve a fish 525 stuck in the wellbore, according to another embodiment of the present invention. The fishing assembly 500 may include a workstring 505, a slinger 510, drill collars 515, a jar 600, a bumper sub 520, a data sub 550, and an overshot 800. The fish 525 may be a lower portion of a drill string. The components of the fishing assembly may each be longitudinally and rotationally coupled, such as with threaded connections. The workstring 505 may be coiled tubing or drill pipe. The upper portion of the drill string (not shown) may have been removed by a freepoint operation, by operation of a release sub (discussed below), or the drill string may have separated by failure and the upper portion may have been simply retrieved to the surface. Alternatively, instead of the overshot 800, the fishing assembly 500 may include any other gripper for engaging the fish, such as a spear, wire rope grapple, wire rope spear, or a tapper tip.

Additionally, the fishing assembly may include an overpull generator (not shown). Such a generator is discussed and illustrated in U.S. patent application Ser. No. 12/023,864, filed Jan. 31, 2008, which is herein incorporated by reference in its entirety. The overpull generator may be operable to create a force which is used by the other components in the fishing assembly 500 to dislodge the fish 525. The energy may be generated by moving a piston rod of the overpull generator between an extended position and a retracted position. The overpull generator may include a plurality of pistons that activate due to a pressure drop caused by a flow restriction through the overpull generator.

Figure 5A:
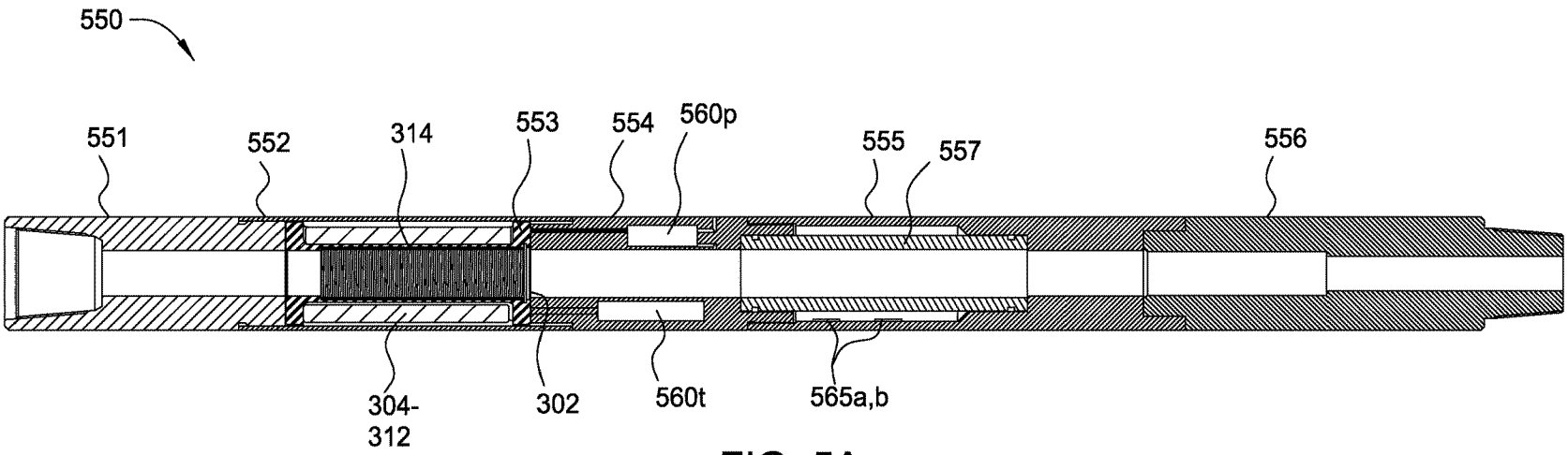
FIG. 5A is a cross section of a data sub of the fishing assembly.

FIG. 5A is a cross section of the data sub 550. The data sub 550 may include an upper adapter 551, a cover 552, a housing 553, the electronics package 300, a pressure and temperature (PT) sub 554, a torque sub 555, a lower adapter 556, and a mud pulser 557.

The adapters 551,556 may each be tubular and have a threaded coupling formed at a longitudinal end thereof for connection with other components of the fishing assembly 500. The housing 553 may be disposed between the upper adapter 551 and the PT sub 554. The PT sub 554 may be longitudinally and rotationally coupled to the cover 552, such as with fasteners (not shown) and sealed, such as with one or more o-rings. The cover 552 may be longitudinally and rotationally coupled to the upper adapter 551, such as with fasteners (not shown) and sealed, such as with one or more o-rings. The torque sub 555 may be longitudinally and rotationally coupled to the PT sub 554 with a threaded connection. The lower adapter 556 may be longitudinally and rotationally coupled to the torque sub 555 with a threaded connection.

The PT sub 554 may include a temperature sensor 560*t* and a pressure sensor 560*p*. The pressure sensor 560*p* may be in fluid communication with a bore of the PT sub 554 via a first port and in fluid communication with the wellbore 501 via a second port. The sensors 560*p,t* may be in data communication with the microprocessor 310 by engagement of contacts formed at a bottom of the housing with corresponding contacts formed at a top of the PT sub 554. The sensors 560*p,t* may also receive electricity via the contacts.

The torque sub 555 may include one or more sensors, such as strain gages 565*a,b* bonded to an inner surface thereof. The strain gage 565*a* may be oriented to measure longitudinal strain and the strain gage 565*b* may be oriented to measure torsional strain. The strain gages 565*a,b* may be in data and electrical communication with the microprocessor via contacts (not shown) or one or more wires (not shown) extending through the PT sub 554. The torque sub 555 may further include one or more accelerometers for measuring shock and/or vibration. Alternatively (discussed below) the data sub 550 may be disposed in a drilling assembly and the data sub may include one or more gyroscopes for measuring orientation of a drill bit. Additionally, the data sub may include a camera (i.e., optical or infrared) for recording downhole video. Additionally, the data sub 550 may include a rotation sensor for measuring rotation and/or rotational velocity of the data sub. Additionally, the data sub 550 may include a circulation valve and an actuator operable by the microprocessor.

The mud pulser 557 may be disposed between PT sub 554 and the torque sub 555. The mud pulser 557 may be in electrical and data communication with the microprocessor 310 via contacts or wires (not shown) extending through the PT sub 554. The mud pulser 557 may include a valve (not shown) and an actuator for variably restricting flow through the pulser, thereby creating pressure pulses in drilling fluid pumped through the mud pulser. The mud pulses may be detected at the surface, thereby communicating data from the microprocessor to the surface. The mud pulses may be positive, negative, or sinusoidal.

Alternatively, an electromagnetic (EM) gap sub may be used instead of the mud pulser, thereby allowing data to be transmitted to the surface using EM waves. Alternatively, an RFID tag launcher may be used instead of the mud pulser. The tag launcher may include one or more RFID tags. The microprocessor 310 may then encode the tags with data and the launcher may release the tags to the surface. Alternatively, an acoustic transmitter may be used instead of the mud pulser. Alternatively, and as discussed above, instead of the mud pulser RFID tags may be periodically pumped through the data sub and the microprocessor may send the data to the tag. The tag may then return to the surface via an annulus formed between the workstring and the wellbore. The data from the tag may then be retrieved at the surface. Alternatively, and as discussed above, instruction signals may be sent to the electronics package using mud pulses, EM waves, or acoustic signals instead of RFID tags. Alternatively, the fishing assembly may be wired so that communication from the surface to the data sub and vice versa may use the wire. Additionally, the data sub may be used with any of the tools disclosed herein.

In operation, when it is desired to activate the data sub 550, an RFID tag 350*a,p* may be pumped/dropped through the workstring 505 to the antenna 302, thereby conveying an instruction signal from the surface. The tag 350*a,p* may also be used to operate the jar 600 and/or overshot 800 (discussed below). The microprocessor 310 may then begin recording data from the PT sub 554 and the torque sub 555 and transmitting the data to the surface using the mud pulser 557. The surface operator may then receive real-time data during the fishing operation. Alternatively, the electronics package 300 may include a memory unit (not shown) and the microprocessor 310 may record data before the instruction signal is sent and begin transmitting data after the instruction is sent. Alternatively, the microprocessor 310 may filter the data and transmit only certain measurements, i.e., maximums, to conserve bandwidth.

Instead of or in addition to receiving an instruction signal from the surface, the microprocessor 310 may be programmed to wait for and detect a trigger event before transmitting data. For example, the trigger event may be a tensile load that surpasses a predetermined value. Another example of a trigger event is an increase in pressure, or several increases in pressure that prescribe to a specified pattern. This pattern may be interpolated by the microprocessor to process a different set of data, start or stop recording/transmitting, or perform a specified action.

For deeper wells, the fishing assembly 500 may further include a signal repeater (not shown) to prevent attenuation of the transmitted mud pulse. The repeater may detect the mud pulse transmitted from the mud pulser 557 and include its own mud pulser for repeating the signal. As many repeaters may be disposed along the workstring as necessary to transmit the data to the surface, i.e., one repeater every five thousand feet. These repeaters may be adapted to perform dual functions and in one embodiment may be stabilizers on the workstring (see FIG. 19 of the '511 provisional). Each repeater may also be a data sub and add its own measured data to the retransmitted data signal. If the mud pulser is being used, the repeater may wait until the data sub is finished transmitting before retransmitting the signal. The repeaters may be used for any of the mud pulser alternatives, discussed above. Repeating the transmission may increase bandwidth for the particular data transmission. The increased bandwidth may allow high demand transmissions, such as video.

Alternatively, multiple subs may be deployed in a workstring or drill string. An RFID tag including a memory unit may be dropped/pumped through the data subs and record the data from the data subs until the tag reaches a bottom of the data subs. The tag may then transmit the data from the upper subs to the bottom sub and then the bottom sub may transmit all of the data to the surface.

Figure 6:
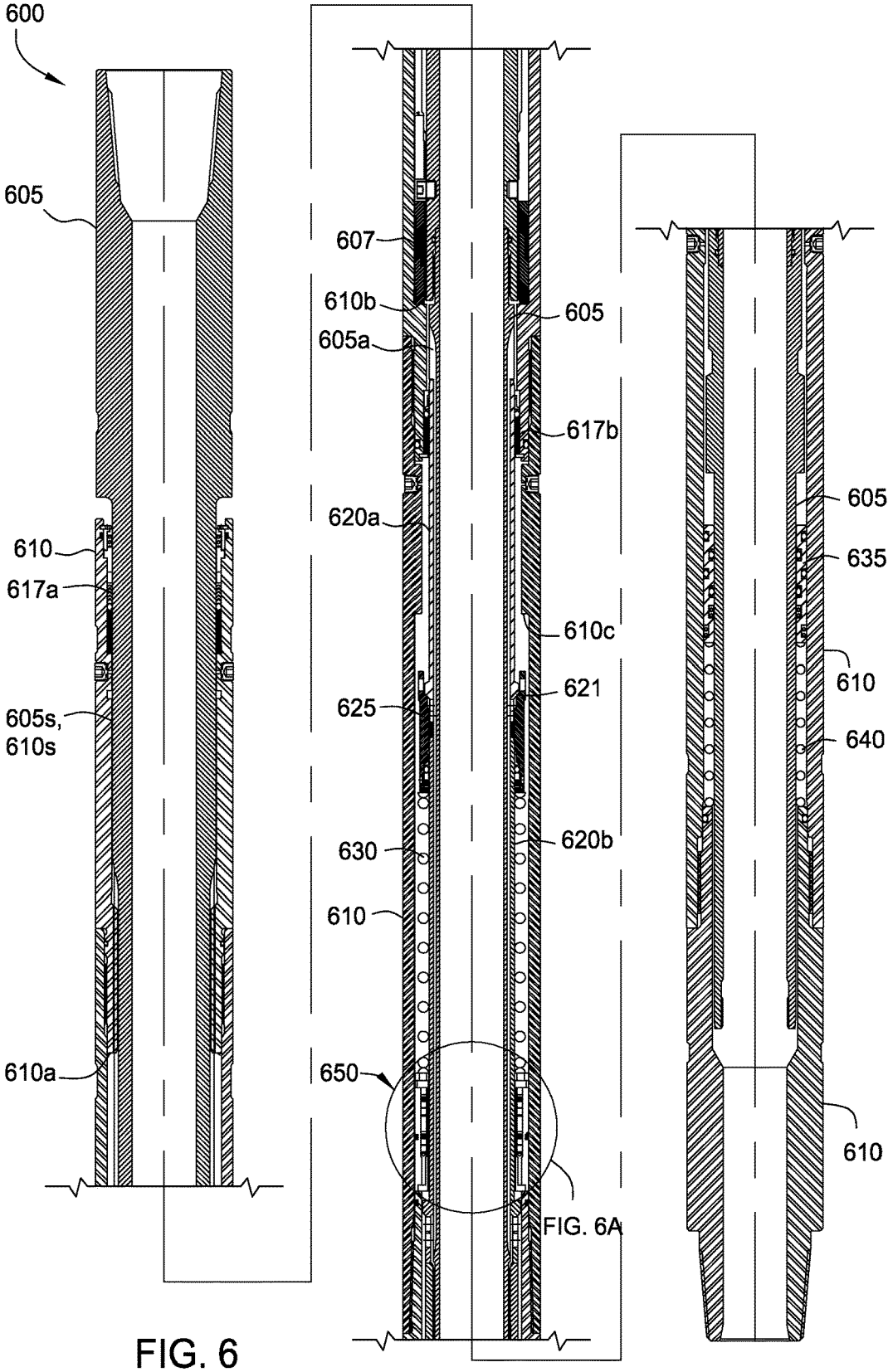
FIG. 6 is a cross section of a jar of the fishing assembly.
Figure 6A:
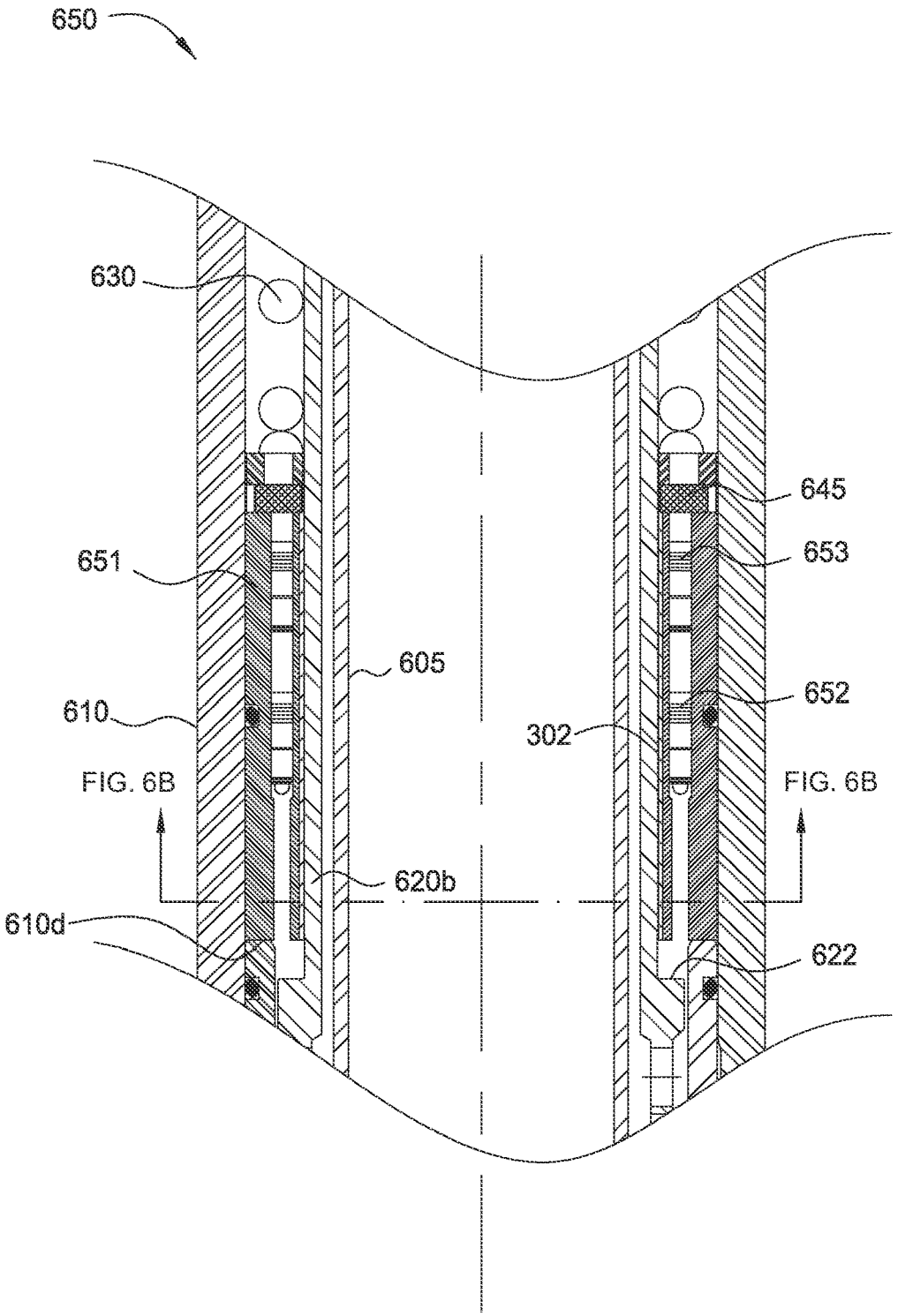
FIG. 6A is an enlarged portion of FIG. 6.
Figure 6B:
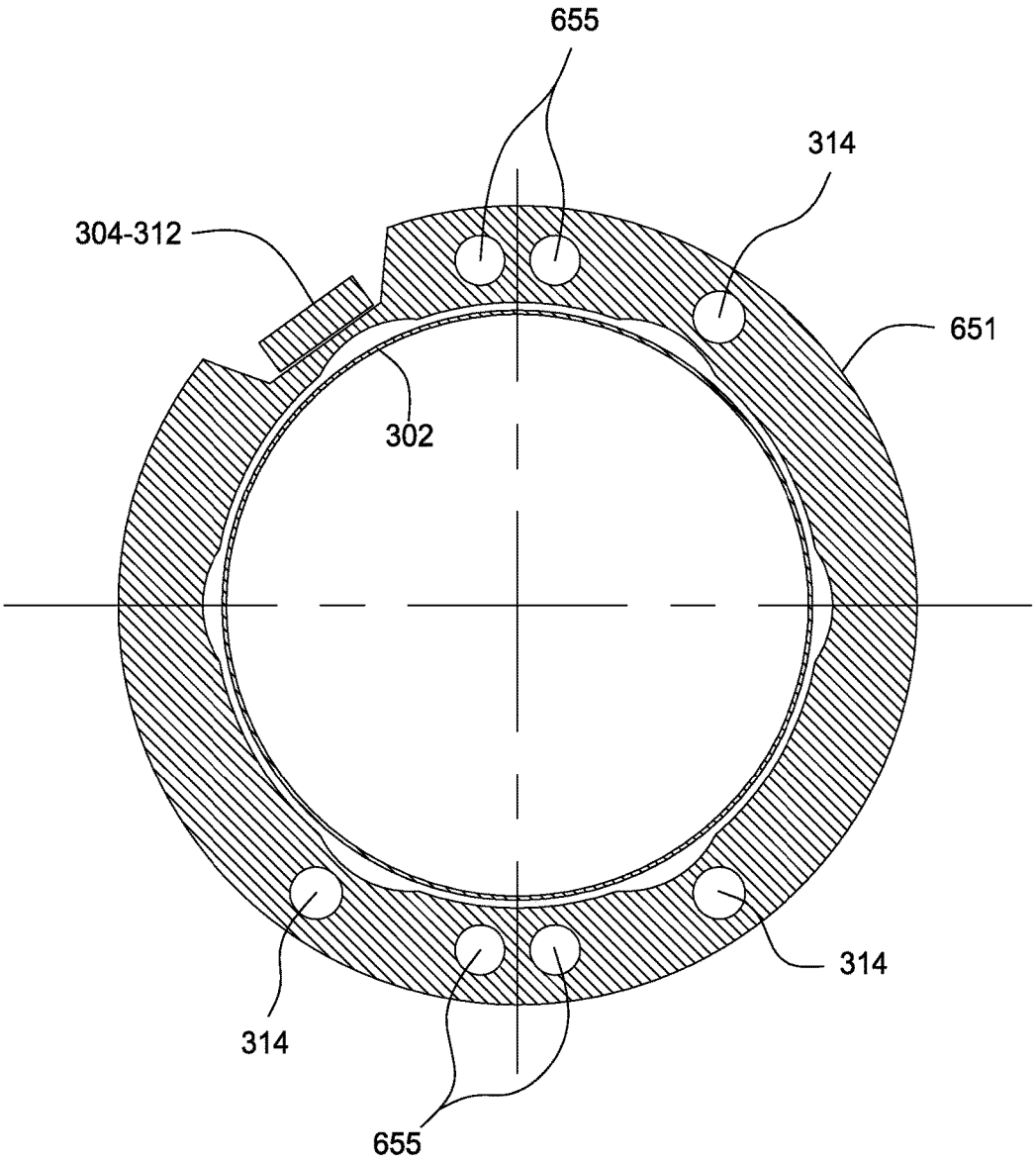
FIG. 6B is a cross section of FIG. 6A.

FIG. 6 is a cross section of the jar 600. FIG. 6A is an enlarged portion of FIG. 6. FIG. 6B is a cross section of FIG. 6A. The jar 600 may include a mandrel 605, a housing 610, a hammer 607, one or more sleeves, such as upper sleeve 620*a* and lower sleeve 620*b*, a piston 650, a traveling valve 625, a biasing member, such as a spring 630, a balance piston 635, and a balance spring 640.

The mandrel 605 and the housing 610 may each be tubular and each have a threaded coupling formed at a longitudinal end thereof for connection with other components of the fishing assembly 500. To facilitate manufacture and assembly, each of the mandrel 605 and housing 610 may include a plurality of longitudinal sections, each section longitudinally and rotationally coupled, such as by threaded connections, and sealed, such as by O-rings. The mandrel 605 and the housing 610 may be rotationally coupled by engagement of longitudinal splines 605*s*, 610*s* formed along an outer surface of the mandrel and an inner surface of the housing. The housing 610 and the mandrel 605 may be longitudinally coupled in a locked position by closure of a valve in the piston 650 (discussed below). In an unlocked position, the housing 610 and the mandrel 605 may be longitudinally movable relative to each other until upwardly stopped by engagement of the hammer 607 and an anvil 610*a* formed by a bottom of one of the housing sections and downwardly stopped by engagement of the hammer with a shoulder 610*b* formed in an inner surface of the housing. A seal assembly 617*a* may be disposed between the housing 610 and the mandrel 605 to isolate a reservoir chamber radially formed between the housing 610 and the mandrel 605 and between the sleeves 620*a,b* and the mandrel and longitudinally formed between the seal assembly 617*a* and the balance piston 635.

The hammer 607 may be longitudinally coupled to the mandrel by a threaded connection and one or more fasteners, such as set screws. The mandrel 605 may be received by a bore formed through the housing 610. The sleeves 620*a,b* may be disposed between the housing 610 and the mandrel 605. A seal assembly 617*b* may be disposed between the upper sleeve 620*a* and the housing 610 to isolate a compression chamber formed radially between the upper sleeve and the housing and longitudinally between the seal assembly 617*b* and the piston 650. The compression and reservoir chambers may be filled with a hydraulic fluid, such as oil. A top of the upper sleeve 620*a* may abut one or more protrusions 605*a* (not cut in this cross section) formed on an outer surface of the mandrel 605, thereby stopping upward longitudinal movement of the upper sleeve 620*a* relative to the mandrel.

A shoulder may be formed in a lower portion of the upper sleeve 620*a*. The shoulder may have a tapered surface for engaging a corresponding tapered surface formed in an inner surface of the traveling valve 625, thereby forming a metal-to-metal seal 621. The seal 621 may radially isolate the compression chamber from the reservoir chamber. The lower sleeve 620*b* may longitudinally float between an upper stop formed by abutment of a top of the lower sleeve and a bottom of the upper sleeve 620*a* and a lower stop formed by abutment of a bottom of the lower sleeve and a top of one of the mandrel sections. An inner surface of the lower sleeve 620*b* may form a shoulder 622.

The piston 650 may include a body 651, one or more chokes 652, one or more actuators 653, and the electronics package 300. The body 651 may be annular and include one or more flow ports 655 formed longitudinally therethrough. A choke 652 and an actuator 653 may be disposed in each flow port 655. The body 651 may further house one or more batteries 314 and the components 304-312 may be molded in a recess formed in an outer surface of the body 651. The antenna 302 may be molded into an inner surface of the body 651. Seals, such as o-rings, may be disposed between the piston 650 and the housing and between the piston 650 and the lower sleeve. The piston 650 may rest against a shoulder 610*d* formed by a top of one of the housing segments. The spring 630 may be longitudinally disposed between the piston 650 and the traveling valve 625, thereby biasing the piston and the traveling valve longitudinally away from each other. A filter 645 may be disposed between the piston 650 and the spring 630 to keep particulates out of the ports 655. The actuator 653 may be a solenoid operated valve, such as a check valve, operable between a closed position where the valve functions as a check valve oriented to prevent flow from the compression chamber to the reservoir chamber (downward flow) and allow reverse flow therethrough, thereby fluidly locking the jar 600 and an open position where the valve allows flow through the respective port 655 (in either direction). Alternatively, a solenoid operate shutoff valve may be used instead of the check valve.

In operation, the jar 600 may be run-in as part of the fishing assembly 500 in a locked position so as to prevent unintentional operation or firing of the jar until the jar is ready to be operated (i.e., after the overshot has engaged the fish). An RFID tag 350*a,p* may be pumped/dropped through the workstring 505 to deliver an instruction signal to the microprocessor 310. The microprocessor 310 may then supply electricity to the actuator 653, thereby opening the check valve and unlocking the jar 600. Tension may be exerted from the surface on the mandrel 605 via the workstring, thereby moving the mandrel 605 longitudinally upward relative to the housing 610. The mandrel 605 may carry lower sleeve 620*a* upward causing the lower sleeve shoulder 622 to engage a bottom of the piston 650 and carrying the piston upward. The traveling valve 625 may also be carried upward by the spring 630. A top of the lower sleeve 620*b* also engages a top of the upper sleeve 620*a*, thereby carrying the upper sleeve upward.

Upward movement of the piston 650 forces oil in the compression chamber through the chokes 652 in the ports 655, thereby damping movement of the piston, increasing pressure in the compression chamber, and storing energy in the drill collars 515 in the form of elastic elongation or stretch. Increased pressure in the compression chamber may act on the upper sleeve shoulder, thereby causing the upper sleeve shoulder to act as a piston pushing the upper sleeve downward into tight engagement with the traveling valve 625. The energy storage continues until a top of the traveling valve 625 engages a shoulder 610*c* formed in an inner surface of the housing 610, thereby stopping upward movement of the traveling valve 625. Upward movement of the mandrel and sleeves may continue, thereby unseating the upper sleeve from the traveling valve and opening the metal to metal seal 621.

Opening of the seal 621 allows fluid flow from the compression chamber to the reservoir chamber, thereby releasing fluid pressure from the compression chamber and bypassing the choked ports 655. The free flow of fluid also releases the elastic energy built up in the drill collars 515, thereby causing the hammer 607 to rapidly accelerate toward and strike the anvil 610*a* and deliver a violent impact or jar to the fish 525. Operation of the jar 600 may be repeated until the fish is freed. Once the fish is freed, a second RFID tag may be dropped/pumped to the piston 650 instructing the piston to re-lock the jar 600 so that the fishing assembly 500 and fish 525 may be retrieved to the surface.

Alternatively, the jar may be disposed in the workstring upside down to deliver a downward blow. Additionally, a second jar may be disposed in the workstring upside down. Alternatively, the jar may be operable to fire in a downward direction in addition to the upward direction. Alternatively, the jar may be disposed in a drill string for freeing the drill string should the drill string become stuck during drilling.

Figure 6E:
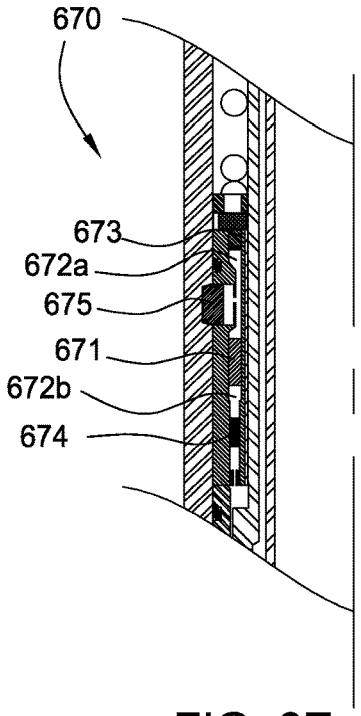
FIGS. 6E and 6F illustrate an alternative embodiment of the piston.
Figure 6C:
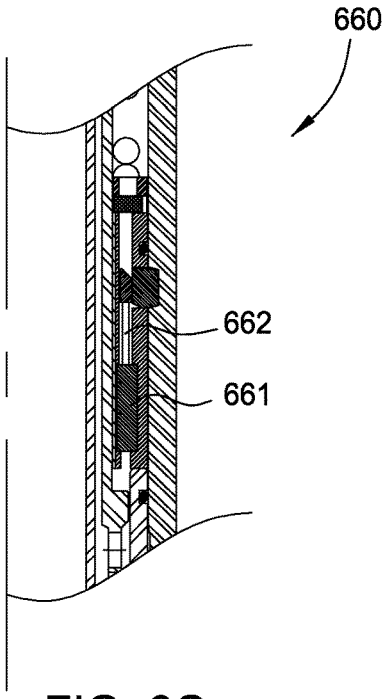
FIGS. 6C and 6D illustrate an alternative embodiment of the piston.
Figure 6F:
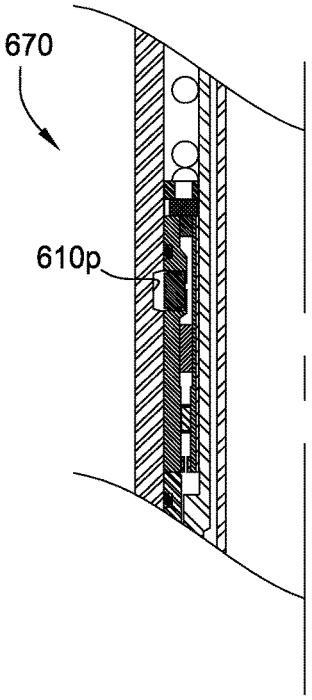
Figure 6D:
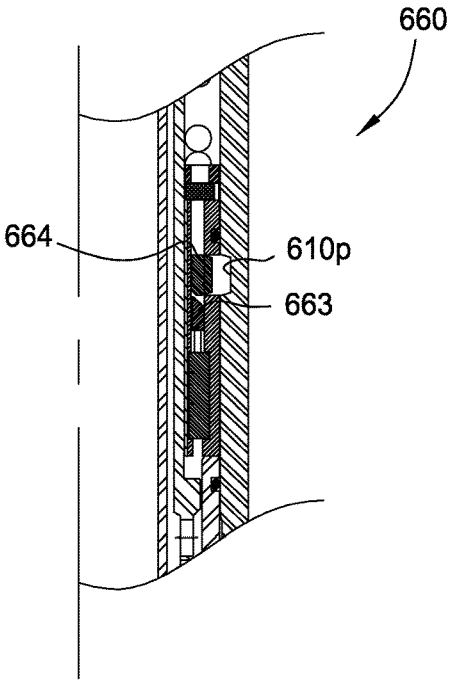

FIGS. 6C and 6D illustrate an alternative embodiment 660 of the piston 650. Instead of a solenoid operated check valve in the fluid port 655, the actuator may be separately housed in the body. The housing may include a profile 610*p* formed in an inner surface thereof. The actuator may include an electric motor 661 engaged with a threaded rod 662. A wedge block 663 may be longitudinally and rotationally coupled to an end of the rod 662. In the locked position, a dog 664 may be extend through a radial port formed in the body and into the profile 610*p*, thereby longitudinally coupling the piston 660 to the housing. The wedge block 663 may radially abut the dog 664, thereby locking the dog in the profile 610*p*. To unlock the piston 660, the microprocessor may supply electricity to the motor 661, thereby rotating a nut (not shown) engaged with the rod 662 and longitudinally moving the rod and the block 663 downward away from the dog 664. The dog 664 may then be free to move radially inward, thereby uncoupling the piston 660 from the housing. Alternatively, a solenoid may be used to move the rod 662.

FIGS. 6E and 6F illustrate an alternative embodiment 670 of the piston 650. The actuator may be housed in a separate flow port formed through the body. A plug 673 may isolate an actuation chamber 672*a* formed between the plug and an electric pump 671. A relief chamber 672*b* may be formed between the pump and a balance piston 674. A dog piston 675 may be disposed in the actuation chamber 672*a*. The chambers 672*a, b* may be filled with a hydraulic fluid, such as oil. In the locked position, fluid pressure in the actuation chamber may force the dog into the housing profile. To unlock the piston, the microprocessor may supply electricity to the pump, thereby pumping fluid from the actuation chamber to the relief chamber. The dog may then be free to move radially inward, thereby uncoupling the piston from the housing.

Figure 7:
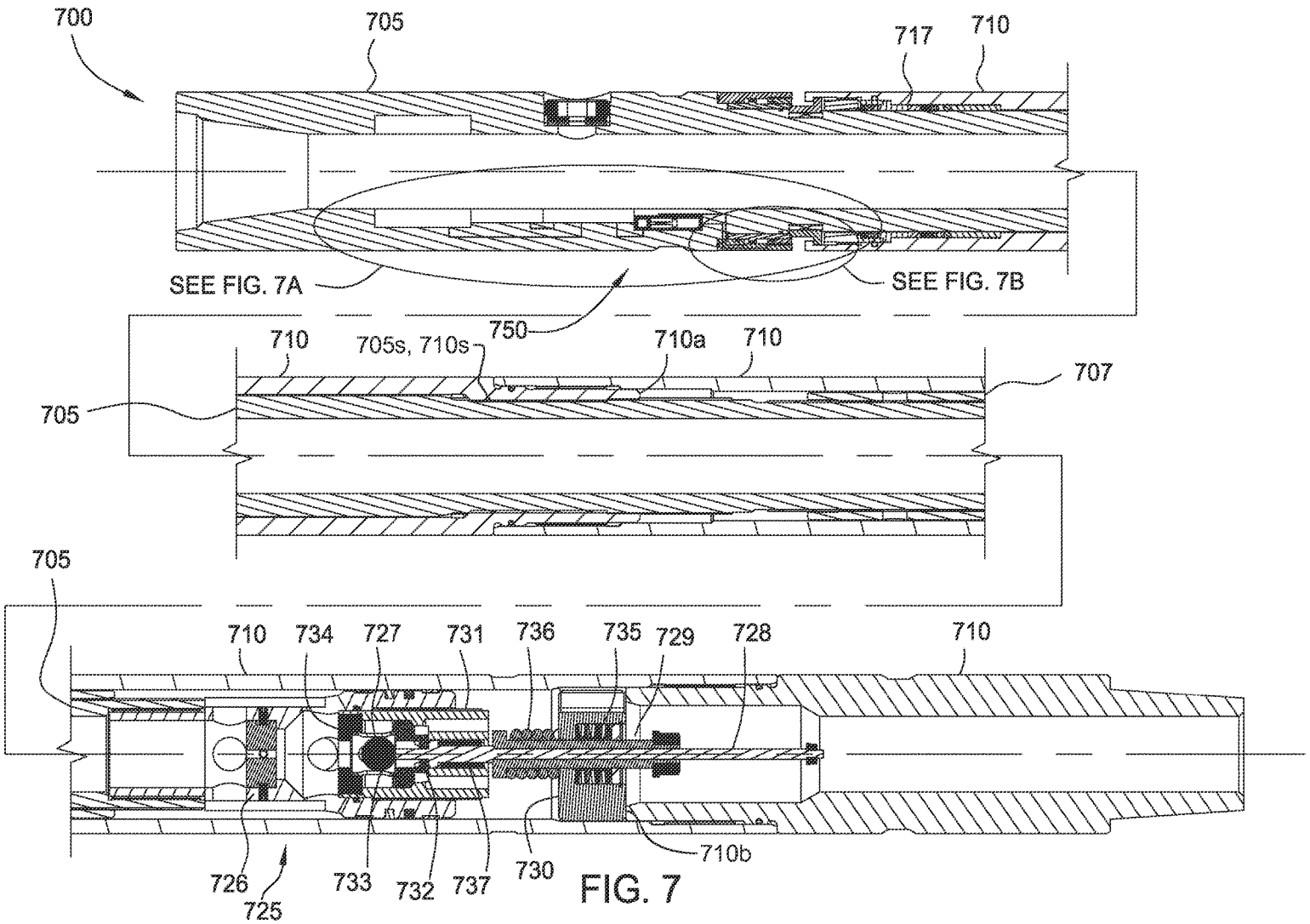
FIG. 7 is a cross section of an alternative vibrating jar 700.

FIG. 7 is a cross section of an alternative vibrating jar 700. The jar 700 may include a mandrel 705, a housing 710, a hammer 707, a traveling valve 725, and a latch 750.

The mandrel 705 and the housing 710 may each be tubular and each have a threaded coupling formed at a longitudinal end thereof for connection with other components of the fishing assembly 500. To facilitate manufacture and assembly, the housing 710 may include a plurality of longitudinal sections, each section longitudinally and rotationally coupled, such as by threaded connections, and sealed, such as by O-rings. The mandrel 705 and the housing 710 may be rotationally coupled by engagement of longitudinal splines 705*s*, 710*s* formed along an outer surface of the mandrel and an inner surface of the housing. The housing 710 and the mandrel 705 may be longitudinally coupled in a locked position by the latch 750 (discussed below). In an unlocked position, the housing 710 and the mandrel 705 may be longitudinally movable relative to each other until upwardly stopped by engagement with the hammer 707 and an anvil 710*a* formed by a bottom of one of the housing sections. A seal assembly 717 may be disposed between the housing and the mandrel to isolate a pressure chamber formed by the mandrel bore and the traveling valve 725.

The traveling valve 725 may include a body 726, a ball 727, a stem 728, a collar 729, a slider 730, a sleeve 731, a seat 732, a cage 733, a cover 734, a slider spring 735, a collar spring 736, and a stem spring 737. In operation, when the jar 700 is unlocked (discussed below), the mandrel 705 may be moved longitudinally upward relative to the housing 710 until the hammer 707 is proximate to the anvil 710*a*. The slider 730 may be moved from a shoulder 710*b* formed by a top of one of the housing sections. Drilling fluid, such as mud, may be pumped through the mandrel bore and into the traveling valve 725. Fluid pressure then pushes the ball 727 against the seat 732, thereby forming a piston. The fluid pressure then increases, thereby elastically elongating the mandrel 705 and the drill collars 515 and moving the slider 730 toward the shoulder 710*b*. When the slider 730 contacts the shoulder, continued movement pushes the stem 728 against the ball 727 until the force is sufficient to overcome the fluid force pushing the ball against the seat 732. Unseating of the ball 727 releases the fluid pressure in the pressure chamber through a port (not shown) formed in the seat and the elastic energy stored in the drill collars 515, thereby causing the hammer 707 to strike the anvil 710*a* and resetting the jar 700. Actuation of the jar 700 may then cyclically repeat as long as injection of the drilling fluid is maintained.

Figure 7A:
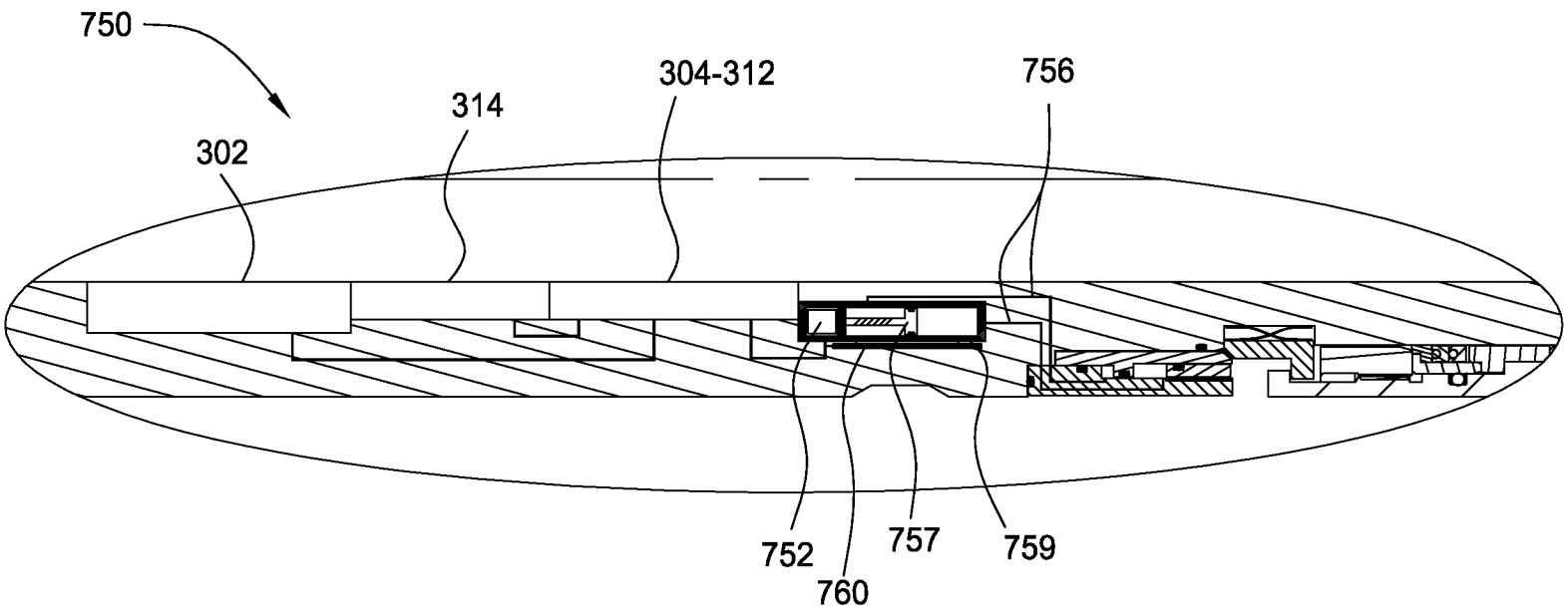
FIG. 7A is an enlarged view of the latch.
Figure 7C:
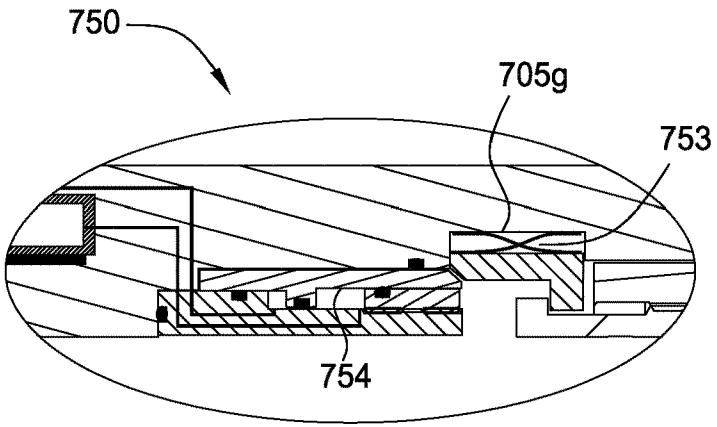
FIG. 7C is a further enlarged view of the latch in the locked position.
Figure 7B:
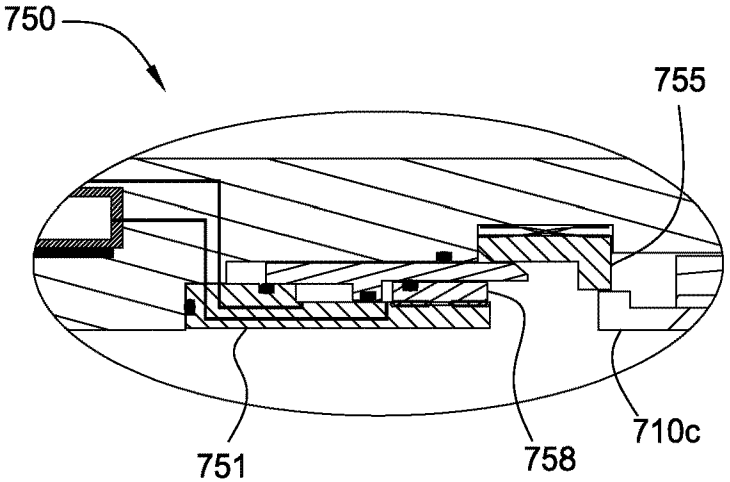
FIG. 7B is a further enlarged view of the latch in the unlocked position.

FIG. 7A is an enlarged view of the latch 750. FIG. 7B is a further enlarged view of the latch 750 in the unlocked position. FIG. 7C is a further enlarged view of the latch 750 in the locked position. The latch 750 may include the electronics package 300, a body 751, an electric motor 752, a spring 753, an actuating piston 754, a lock 755, ports 756, a threaded piston 757, a gland 758, and a cylinder 759. The cylinder 759, the ports 756, and a chamber formed between the body 751 and the gland 758 may be filled with a hydraulic fluid, such as oil. The lock 755 may be received in a groove 705*g* formed in an outer surface of the mandrel. The lock 755 may be a split ring to allow radial expansion and contraction thereof. The lock 755 may be radially biased into the locked position by the spring 753. In the locked position, a lip formed at the bottom of the lock 755 may engage a lip 710*c* formed at a top of the housing, thereby longitudinally coupling the housing 710 and the mandrel 705 and preventing operation of the jar 700.

To move the lock to the unlocked position, thereby freeing the jar 700 for operation, a tag 350*a,p* may be pumped/dropped through the workstring 505 to the antenna 302, thereby conveying an instruction signal from the surface. The microprocessor 310 may then supply electricity from the battery 314 to the motor 752. The motor 752 may then rotate a nut (not shown) engaged with the threaded piston 757, thereby longitudinally moving the threaded piston in the cylinder 759 and forcing hydraulic fluid through the ports and to the actuating piston 754. The fluid may push an inclined surface of the actuating piston 754 into engagement with a corresponding inclined surface of the lock 755, thereby radially pushing the lock into the groove against the spring 753 and disengaging the lock lip from the housing lip. Disengagement of the lock 755 from the housing 710 frees the jar for operation. Once the fish 525 is freed, an additional tag 350*a,p* may be pumped/dropped to the antenna 302 and the process reversed.

As discussed above with reference to the motor lock 200, the latch 750 may further include a position sensor 760 disposed along an inner surface of the mandrel 705 and in electromagnetic communication with the threaded piston 757. Additionally or alternatively, a position sensor may be in electromagnetic communication with the actuating piston 754 and/or the lock 755. Additionally, any of the actuators 660, 670 may include a position sensor (not shown). Alternatively, the microprocessor for any of the jars discussed above may encode a status report to an RFID tag including a memory unit which may then communicate the status report to the data sub to transmit the report to the surface.

Figure 8A:
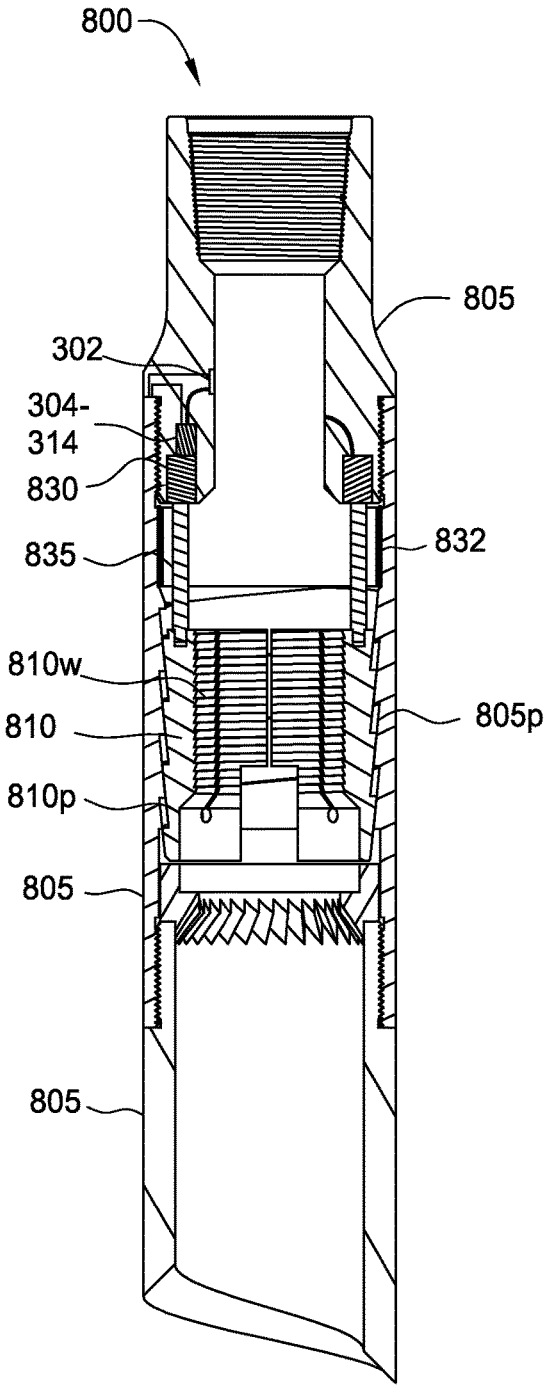
FIG. 8A is a cross section of the overshot in a set position.
Figure 8B:
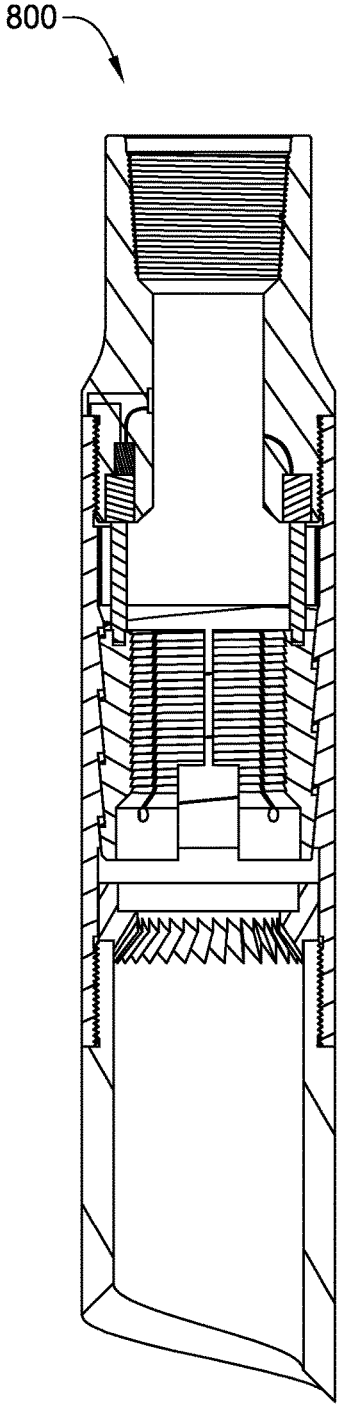
FIG. 8B is a cross section of the overshot in a released position.

FIG. 8A is a cross section of the overshot 800 in a set position. FIG. 8B is a cross section of the overshot 800 in a released position. The overshot 800 may include a housing 805, a grapple 810, and an actuator 825.

The housing 805 may be tubular and have a threaded coupling formed at a longitudinal end thereof for connection with other components of the fishing assembly 500. To facilitate manufacture and assembly, the housing 805 may include a plurality of longitudinal sections, each section longitudinally and rotationally coupled, such as by threaded connections. An inner surface of the housing 805 may taper and form a shoulder 805*s*. A lower portion of the housing 805 below the shoulder may receive an upper portion of the fish 825 so that a top of the fish 825 engages the shoulder 805*s*. An inner surface of the body may form a profile 805*p*. The profile 805*p* may include a series of ramps. The ramps may engage with a profiled 810*p* outer surface of the grapple 810 so that the grapple is longitudinally movable relative to the housing 805 between a radially set position and a released position. To allow radial movement, the grapple 810 may be slotted. An inner surface of the grapple 810 may form wickers or teeth 810*w* for engaging an outer surface of the fish 525, thereby longitudinally coupling the fish 525 to the housing 805. Once the wickers 810*w* engage the outer surface of the fish 525, the workstring 505 may be pulled from the surface, thereby causing the grapple ramps 810*p* to further move longitudinally downward relative to the housing ramps 805*p* and radially pushing the wickers 810*w* further into engagement with an outer surface of the fish 525.

The actuator 825 may move the grapple between the set position and released position. The actuator 825 may include the electronics package 300, one or more electric motors 830, and one or more rods 835. The rods 835 may each be longitudinally coupled to the grapple 810, such as by a threaded connection. The rods 835 may each include a threaded end received by a respective motor 830. Each motor 830 may include a nut (not shown) receiving the rods and a lock (not shown) to prevent movement of the rods when the motor is not operating. Rotation of the nut by each motor 830 moves the rods 835 longitudinally, thereby moving the grapple 810 longitudinally. Alternatively, the actuator 825 may be used in a spear.

As discussed above in relation to the motor lock 200, the actuator 825 may further include a position sensor 832. The position sensor 832 may be disposed along an inner surface of the housing 805 and in electromagnetic communication with each of the rods 835. The position sensor 832 may be in communication with the microprocessor.

In operation, the overshot is run-in in the released position until a top of the fish 525 engages the shoulder 805*s*. A tag 350*a,p* may be pumped/dropped through the workstring 505 to the antenna 302, thereby conveying an instruction signal from the surface. The microprocessor 310 may then supply electricity from the battery 314 to the motors 830. Supplying electricity to the motors may unlock the motors (i.e., a solenoid lock). The motors 830 may then rotate respective nuts engaged with the rods 835, thereby longitudinally moving the grapple 810 downward relative to the housing 805 until the wickers 810*w* engage an outer surface of the fish 525. The motors 830 may then be deactivated, thereby reengaging the locks. The workstring 505 may then be pulled upward further engaging the wickers 810*w* and the fish 525. The jar 600 may then be operated to free the fish 525. If the fish 525 is freed, the fish 525 may then be retrieved from the wellbore 501 to the surface. The drill string may then be redeployed and drilling may then continue. If the fish 525 cannot be freed, the workstring 505 may be lowered to relieve tension between the overshot 800 and the fish 525. A second RFID tag 350*a,p* may be pumped/dropped through the workstring 505, thereby conveying an instruction signal to release the fish 525. The actuation may then be reversed, thereby disengaging the grapple 810 from the fish 525.

Figure 9:
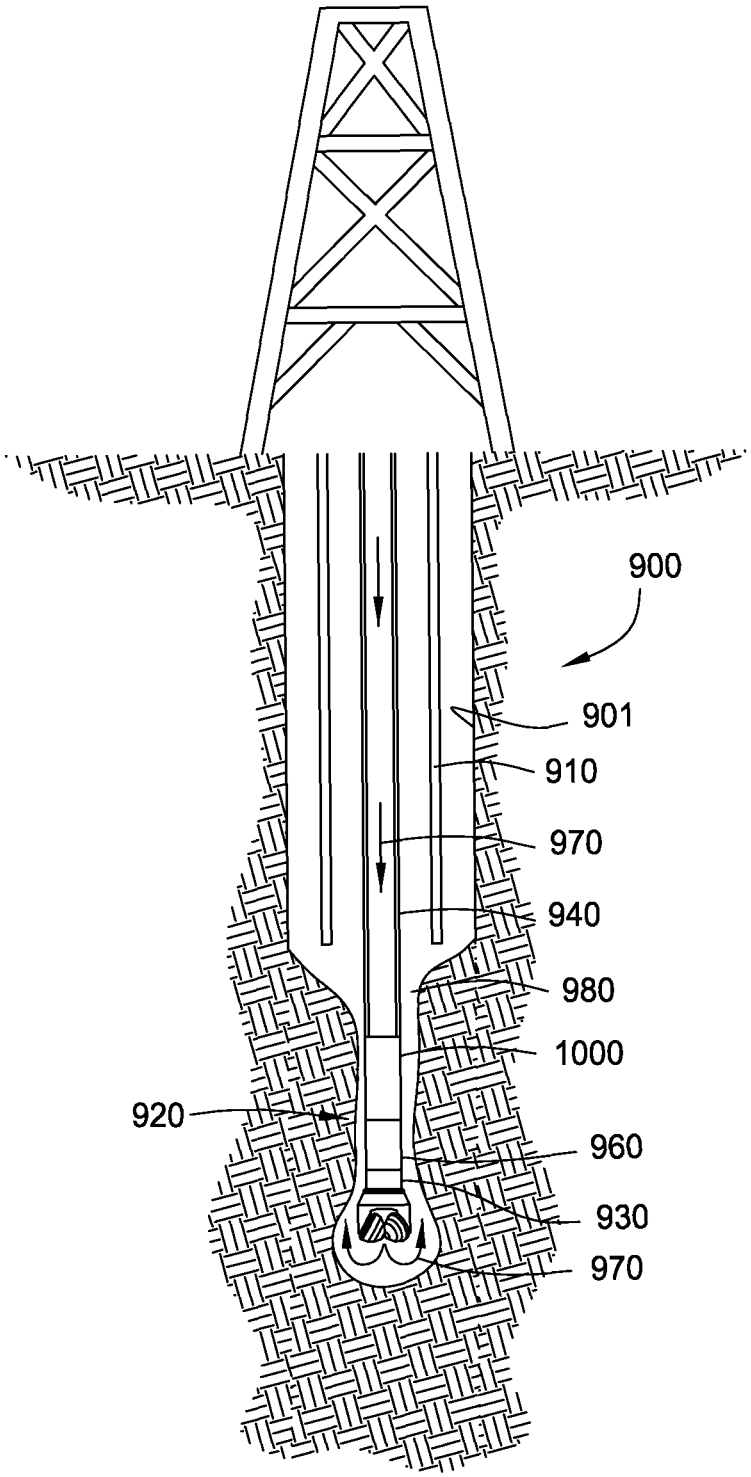
FIG. 9 is a schematic view of a wellbore having a casing and a drilling assembly, according to another embodiment of the present invention.

FIG. 9 is a schematic view of a wellbore 901 having a casing 910 and a drilling assembly 900 which may include drill string 940 and a BHA 920, according to another embodiment of the present invention. The drill string 940 may be joints of drill pipe or casing threaded together or be coiled tubing. The BHA 920 may include a drill bit 930, a disconnect 1000, and other components, such as a mud motor 960, an MWD tool (not shown), and/or a data sub 550. Drilling fluid 970 may be pumped through the drilling assembly 900 from the surface and exit from the bit 930 into an annulus 980, thereby cooling the bit 930, carrying cuttings from the bit 930, lubricating the bit 930, and exerting pressure on an open section of the wellbore 901.

Figure 10I:
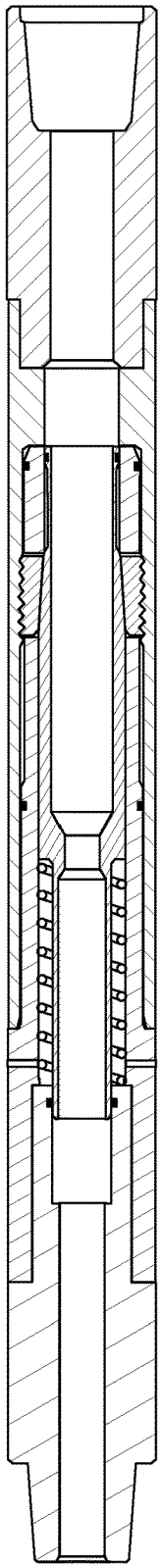
FIG. 10I is a cross section of an alternative disconnect in a locked position.
Figure 10J:
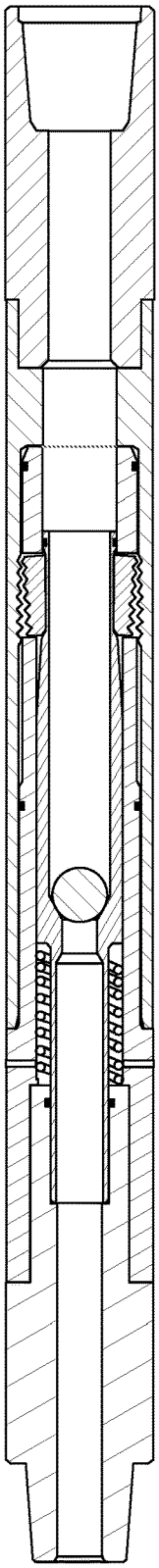
FIG. 10J is a cross section of the disconnect in a released position.
Figure 10A:
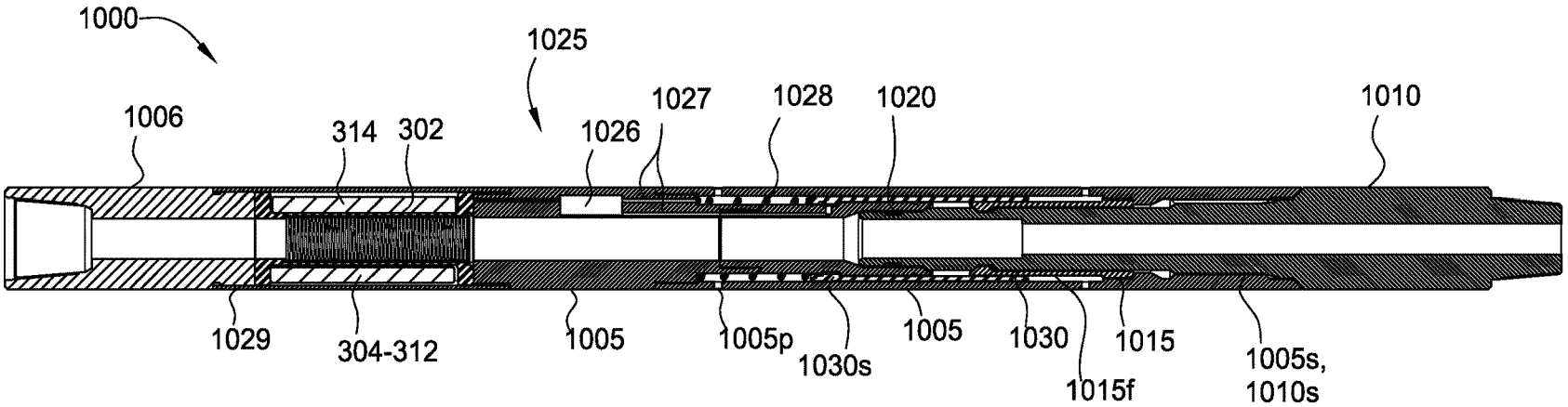
FIG. 10A is a cross section of the disconnect in a locked position.
Figure 10B:
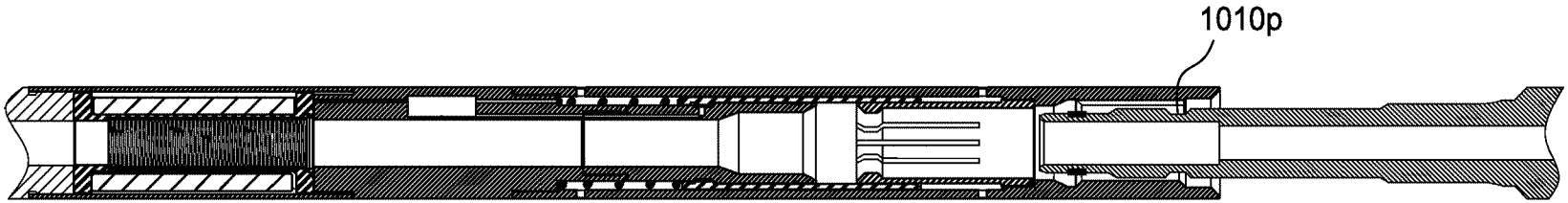
FIG. 10B is a cross section of the disconnect in a released position.

FIG. 10A is a cross section of the disconnect 1000 in a locked position. FIG. 10B is a cross section of the disconnect 1000 in a released position. The disconnect 1000 may include a housing 1005, a mandrel 1010, a latch 1015, a seal assembly 1020, and an actuator 1025. The mandrel 1010 and the housing 1005 may each be tubular and the mandrel may have a threaded coupling formed at a longitudinal end thereof for connection with other components of the drilling assembly 900. The housing 1005 may be longitudinally and rotationally coupled to a cover 1029 of the actuator 1025, such as with fasteners (not shown) and sealed, such as with one or more o-rings. The cover 1029 may be longitudinally and rotationally coupled to an adapter 1006, such as with fasteners (not shown) sealed, such as with one or more o-rings. The adapter 1006 may have a threaded coupling formed at a longitudinal end thereof for connection with other components of the drilling assembly 900. To facilitate manufacture and assembly, the housing 1005 may include a plurality of longitudinal sections, each section longitudinally and rotationally coupled, such as by threaded connections, and sealed, such as by O-rings. The housing 1005 and the mandrel 1010 may be rotationally coupled by engagement of longitudinal splines 1005*s*, 1010*s* formed along an outer surface of the mandrel and an inner surface of the housing.

The latch may be a collet 1015 or dogs (not shown). The collet 1015 may be longitudinally coupled to the housing 1005, such as by a threaded connection. The collet 1015 may include a plurality of slotted fingers 1015*f*, each finger including a profile for engaging a corresponding profile 1010*p* formed in an outer surface of the mandrel. The fingers 1015*f* may move radially to engage or disengage the profile 1010*p*. In the locked position, the fingers 1015*f* may be prevented from moving radially by engagement with a piston 1030, thereby longitudinally coupling the housing 1005 and the mandrel 1010. The seal assembly 1020 may be longitudinally coupled to the mandrel 1010. In the locked position, the seal assembly 1020 may engage an inner surface of the housing, thereby isolating a bore of the disconnect from the wellbore 901.

The actuator 1025 may include the electronics package 300, an electric pump 1026, flow passages 1027, a spring 1028, the cover 1029, the piston 1030, and the body 1031. The electronics package 300 may be housed by the body 1031. The spring 1028 may be disposed in a first chamber between a top of the piston 1030 and the housing 1005, thereby longitudinally biasing the piston 1030 toward the locked position. The first chamber may be in fluid communication with the wellbore 901 via one or more ports 1005*p* formed through the housing 1005. A second chamber may be formed between a shoulder of the piston 1030 and the housing 1005. The second chamber may be in fluid communication with the pump 1026 via a first of the passages 1027 and the pump may be in fluid communication with the first chamber via a second of the passages.

In operation, when it desired to release the mandrel 1010 and the rest of the BHA 920 from the housing 1005 and the drill string 940, the bit 930 may be set on the bottom of the wellbore 901. A tag 350*a,p* may be pumped/dropped through the drill string 940 to the antenna 302, thereby conveying an instruction signal from the surface. The microprocessor 310 may then supply electricity from the battery 314 to the pump 1026. The pump 1026 may intake drilling fluid 970 from the wellbore 901 from the first chamber and supply pressurized fluid to the second chamber, thereby forcing the piston 1030 against the spring 1028 and disengaging a lower end of the piston from the collet fingers 1015*f*. The drill string 940 may then be raised from the surface, thereby pulling the housing 1005 from the mandrel 1010 and forcing the collet fingers 1015*f* to disengage from the mandrel profile 1010*p*. To re-connect the housing 1005 and the mandrel 1010, the housing 1005 may be lowered until the fingers re-engage the profile. A second RFID tag 350*a,p* may be pumped/dropped through the drill string, thereby conveying an instruction signal to re-engage the piston and the collet. The pump may be reversed, thereby pumping fluid from the second chamber to the first chamber and allowing the spring to return the piston to the locked position.

The disconnect 1000 may be operated in the event that the BHA 920 becomes stuck in the wellbore 901, thereby becoming the fish 525. The disconnect 1000 may then be operated to release the BHA/fish and the drill string 940 removed from the wellbore so that the fishing assembly 500 may be deployed. Alternatively, multiple disconnects may be disposed along the drill string. Should the drilling assembly become stuck, the freepoint may be estimated or measured and the disconnect closest to (above) the freepoint may be selectively operated by an RFID tag (uniquely coded for the particular disconnect) and the free portion of the drill string may then be removed.

As discussed above with reference to the motor lock 200, the actuator 1025 may further include a position sensor (not shown) disposed along an inner surface of the housing 1005 and in electromagnetic communication with the piston 1030.

In another embodiment, the disconnect 1000 may be used for a logging operation (not shown, see FIG. 7 of U.S. Pat. App. Pub. No. 2008/0041587, which is herein incorporated by reference in its entirety). Once the BHA has drilled through a formation of interest, the disconnect 1000 may be operated to release the BHA. The drill string may be raised, thereby creating a gap in the drill string corresponding to the zone of interest. A logging tool may then be deployed (i.e. lowered and/or pumped) through the drill string via a workstring, such as wireline or slickline. The logging tool may include a nuclear sensor, a resistivity sensor, a sonic/ultrasonic sensor, and/or a gamma ray sensor. The logging tool may reach the gap and be activated to log the formation of interest. Power and data may be transmitted via the wireline. Alternatively, if slickline is used, the logging tool may include a battery and a memory unit. Once the zone of interest is logged, the logging tool may be raised to the surface and the BHA reconnected to the drill string. Alternatively, instead of or in addition to, the logging tool, a perforation gun may be run-in through the disconnected drill string to the gap and the formation of interest may be perforated. Alternatively, instead of the logging tool, a formation tester may be run-in through the disconnected drill string to the gap and the formation of interest may be tested. The formation tester may include a packer, a pump for inflating the packer, and a flow meter. Such a formation tester is discussed and illustrated in U.S. Pat. App. Pub. No. 2008/0190605, which is herein incorporated by reference in its entirety. Alternatively, the formation of interest may be treated by running a packer in on coiled tubing, setting the packer to isolate the formation, and injecting treatment fluid through the coiled tubing string.

Figure 10C:
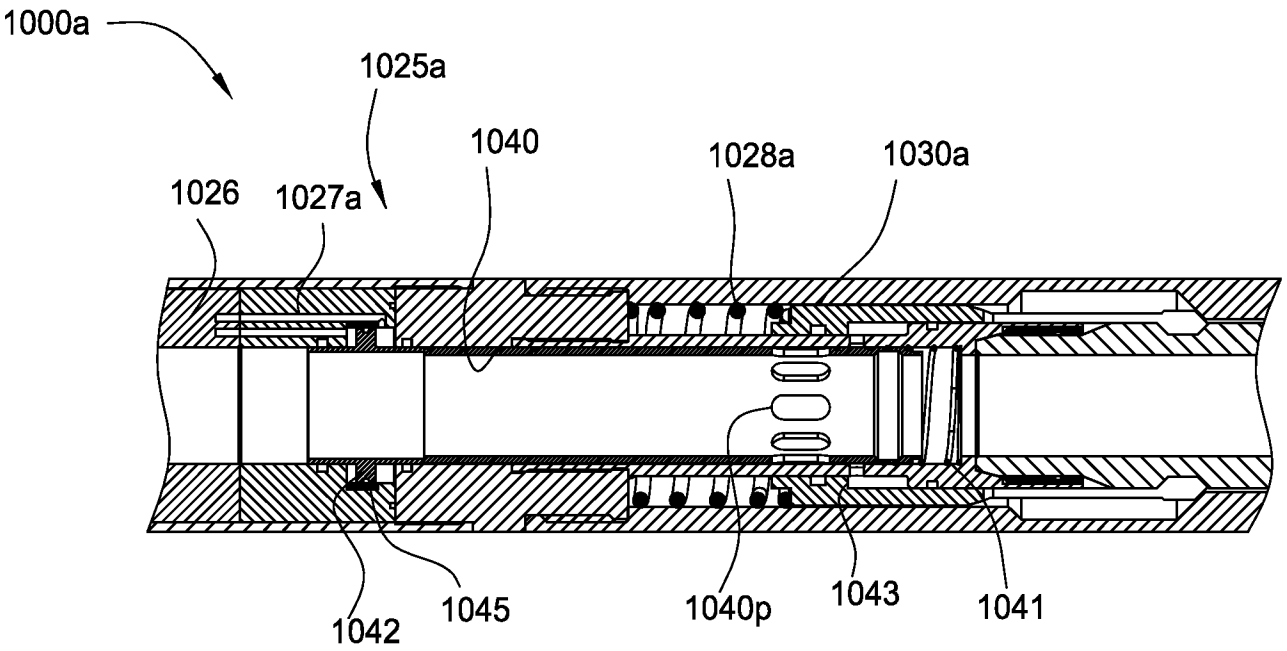
FIG. 10C is a cross section of a portion of an alternative disconnect in a locked position.

FIG. 10C is a cross section of a portion of an alternative disconnect 1000*a* in a locked position. The rest of the disconnect 1000*a* may be similar to the disconnect 1000. The piston 1030 may be omitted. The collet 1015*a* may be a piston 1030*a* instead of threaded to the housing. The disconnect 1000*a* may include an alternative actuator 1025*a*. The alternative actuator may include a valve 1040-1042. The valve 1040-1042 may include a sleeve 1040 having one or more ports 1040*p* formed therethrough, a spring 1041, and a piston 1042. To release the mandrel 1010, the pump 1026 may move the valve piston 1042 downward, thereby moving the sleeve 1040 downward and aligning the valve ports 1040*p* with ports 1043 formed through an inner wall of the housing 1005, thereby providing fluid communication between the disconnect bore and the collet piston. Drilling fluid may then be circulated through the drill string from the surface. Pressure exerted on the collet piston may move the collet piston longitudinally against the spring 1028*a*, thereby disengaging the collet fingers from the mandrel profile. The drill string may then be raised from the surface to disengage the splined portions, thereby completing disengagement of the housing from the mandrel.

As discussed above with reference to the motor lock 200, the actuator 1025*a* may further include a position sensor 1045 in electromagnetic communication with the piston 1042.

Figure 10D:
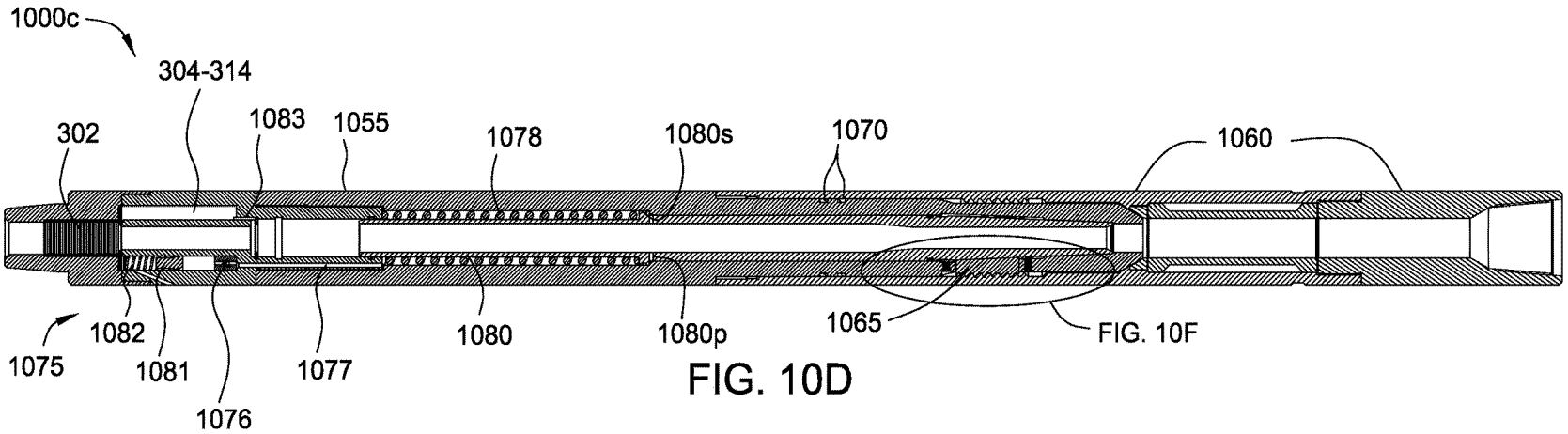
FIG. 10D is a cross section of alternative disconnect in a locked position.
Figure 10E:
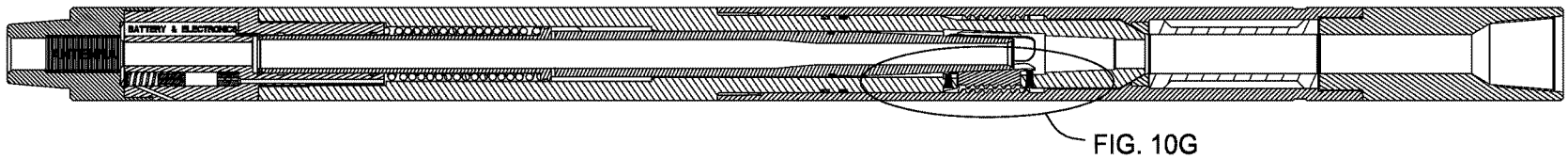
FIG. 10E is a cross section of the disconnect in a released position.
Figure 10G:
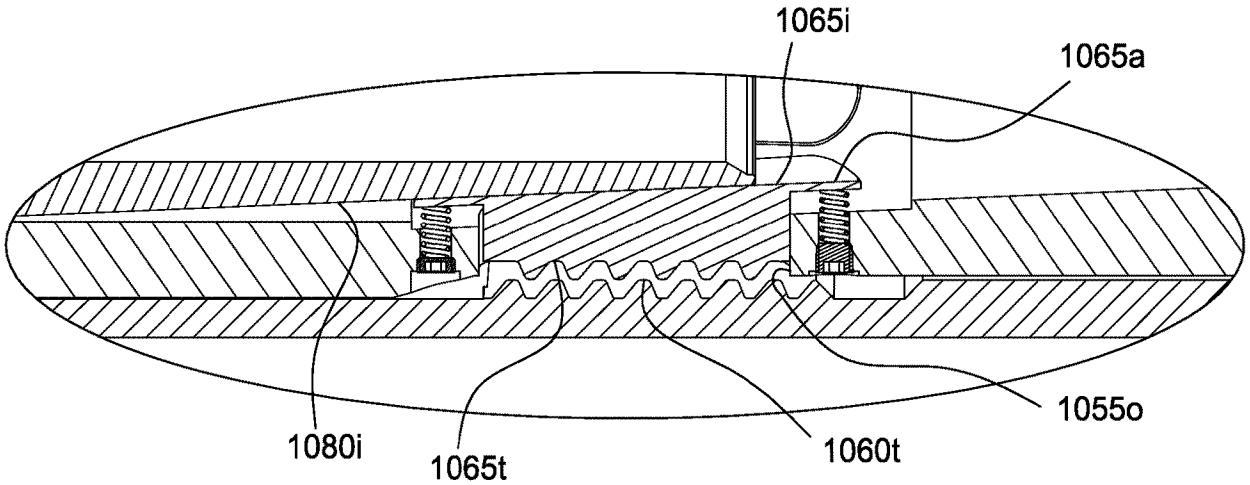
FIGS. 10F and 10G are enlarged portions of FIGS. 10D and 10E.
Figure 10F:
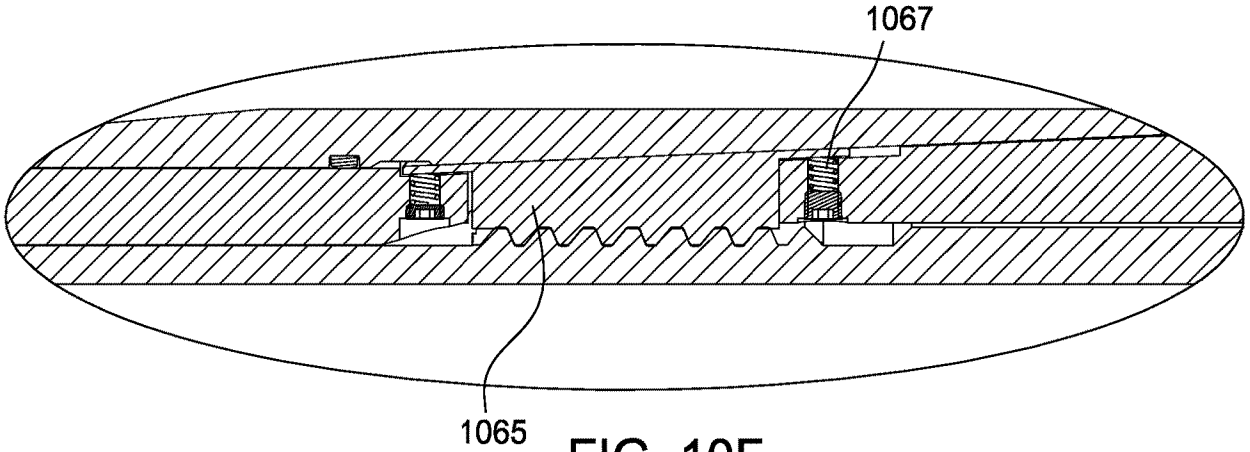

FIG. 10D is a cross section of alternative disconnect 1000*b* in a locked position. FIG. 10E is a cross section of the disconnect 1000*b* in a released position. FIGS. 10F and 10G are enlarged portions of FIGS. 10D and 10E. The disconnect 1000*b* may include a housing 1055, a mandrel 1060, threaded dogs 1065 (only one shown), a seal 1070, and an actuator 1025. The mandrel 1060 and the housing 1055 may each be tubular and the each may have a threaded coupling formed at a longitudinal end thereof for connection with other components of the drilling assembly 900. To facilitate manufacture and assembly, the each of the housing 1055 and mandrel 1060 may include a plurality of longitudinal sections, each section longitudinally and rotationally coupled, such as by threaded connections, and sealed, such as by O-rings.

In the locked position, the dogs 1065 may be disposed through respective openings 1055*o* formed through the housing 1055 and an outer surface of each dog may form a portion of a thread 1065*t* corresponding to a threaded inner surface 1060*t* of the mandrel 1060. Abutment each dog 1065 against the housing wall surrounding the opening 1055*o* and engagement of the dog thread portion 1065*t* with the mandrel thread 1060*t* may longitudinally and rotationally couple the housing 1055 and the mandrel 1060, thereby performing both functions of the splined connection 1005*s*, 1010*s* and the latch 1015. Each of the dogs 1065 may be an arcuate segment, may include a lip 1065*a* formed at each longitudinal end thereof and extending from the inner surface thereof, and have an inclined inner surface. A spring 1067 may disposed between each lip 1065*a* of each dog 1065 and the housing 1055, thereby radially biasing the dog 1065 inward away from the mandrel 1060.

The actuator 1075 may include the electronics package 300, a solenoid valve 1076, flow passages 1077, a spring 1078, a piston 1080, a balance piston 1081, and a balance spring 1082. In a locked position, an inclined outer surface 1080*i* of the piston 1080 may abut the inclined inner surface 1065*i* of each dog 1065, thereby locking the dogs 1065 into engagement with the mandrel 1060 against the dog springs 1067. The electronics package 300 may be housed by one of the housing sections. The actuator spring 1078 may be disposed in a first chamber formed between a shoulder 1080*s* of the piston 1080 and the housing 1055, thereby longitudinally biasing the piston toward the locked position. The first chamber may be in fluid communication with the solenoid valve 1076 via the flow passage 1077. A relief chamber may be formed between the solenoid valve 1076 and the balance piston 1081. The first chamber and the relief chamber may be filled with a hydraulic fluid, such as oil. The solenoid operated valve 1076 may be a check valve operable between a closed position where the valve functions as a check valve oriented to prevent flow from a relief chamber formed between a bottom of the balance piston and the check valve to the first chamber (downward flow) and allow reverse flow therethrough, thereby fluidly locking the disconnect and an open position where the valve allows flow between the chambers in either direction. Alternatively, a solenoid operate shutoff valve may be used instead of the check valve. A top of the balance piston 1081 may be in fluid communication with the wellbore via port 1055*p* formed through an outer wall of the housing 1055.

In operation, when it desired to release the mandrel 1060 and the rest of the BHA 920 from the housing 1055 and the drill string 940, the bit 930 may be set on the bottom of the wellbore 901. A tag 350*a,p* may be pumped/dropped through the drill string 940 to the antenna 302, thereby conveying an instruction signal from the surface. The microprocessor 310 may then supply electricity from the battery 314 to the solenoid valve 1076, thereby opening the solenoid valve. Drilling fluid 970 may then be circulated through the drill string 940 from the surface. Pressure exerted on the piston 1080 may move the piston longitudinally against the spring 1078, thereby disengaging the inclined piston surface 1080*i* from the dogs 1065 and allowing the dog springs 1067 to push the dogs 1065 radially inward away from the mandrel 1060. The drill string 940 may then be raised from the surface, thereby pulling the housing 1055 from the mandrel 1060. To re-connect the housing and the mandrel, the housing may be lowered until the dogs are longitudinally aligned with the threaded portion of the mandrel. Circulation through the drill string may be halted, thereby allowing the spring to push the piston inclined surface toward the dogs, thereby moving the dogs radially outward into re-engagement with the mandrel threaded portion.

The drill string 940 and housing 1055 may then be rotated (i.e., less than sixty degrees) to ensure that the dog threads 1065*t* properly engage the mandrel threads 1060*t*. A second RFID tag 350*a,p* may be pumped/dropped through the drill string 940, thereby conveying an instruction signal to re-lock the piston 1080. The microprocessor 310 may then cease supplying electricity to the solenoid valve 1076, thereby closing the valve. Alternatively, as discussed above with reference to the motor lock 200, the actuator 1075 may include a limit switch 1083 and the microprocessor may close the valve when a top of the piston 1080 engages the limit switch. When circulation is halted, the check valve 1076 will allow the piston to return and engage the dogs. The housing may then be lowered until a bottom of the dog threads 1065*t* engage a top of the mandrel thread 1060*t* and the housing 1055 may be rotated relative to the mandrel 1060 until the dog threads are made up with the mandrel thread.

Figure 10H:
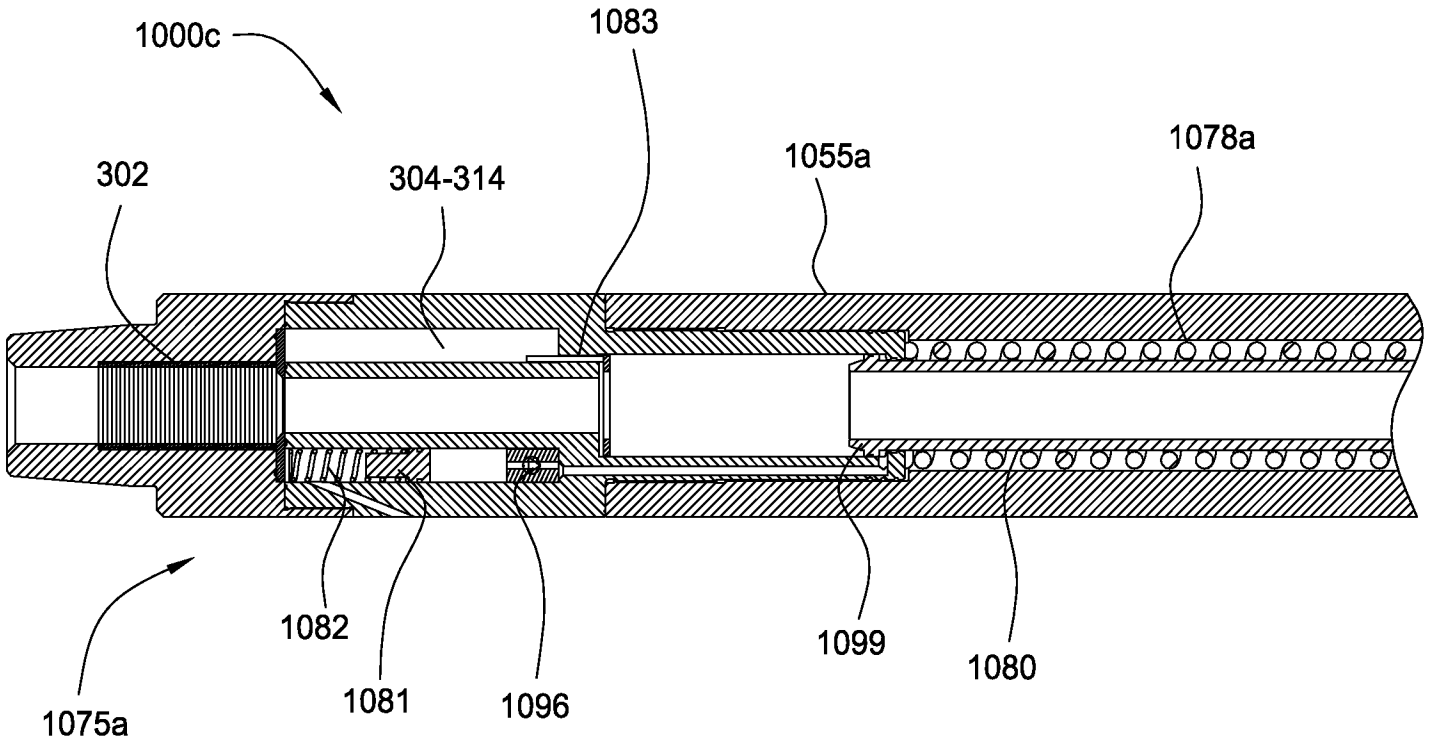
FIG. 10H is a cross section of a portion of an alternative disconnect including an alternative actuator in a locked position.

FIG. 10H is a cross section of a portion of an alternative disconnect 1000*c* including an alternative actuator 1075*a* in a locked position. The ports 1080*p* may be omitted. The rest of the disconnect may be similar to the disconnect 1000*b*. The piston 1078*a* may include a second shoulder 1099 forming a third chamber between the second shoulder and the housing. An electric pump 1096 may replace the solenoid valve. The passage 1077*a* may provide fluid communication between the pump 1096 and the third chamber. The relief chamber and the third chamber may be filled with the hydraulic fluid. The first and second chambers may be in communication with the housing bore or the wellbore.

In operation, when it desired to release the mandrel 1060 and the rest of the BHA from the housing 1055*a* and the drill string, the bit may be set on the bottom of the wellbore. A tag may be pumped/dropped through the drill string to the antenna 302, thereby conveying an instruction signal from the surface. The microprocessor may then supply electricity from the battery to the pump, thereby injecting hydraulic fluid from the relief chamber to the third chamber and forcing the piston to move longitudinally away from the dogs. The piston may move longitudinally against the spring 1078, thereby disengaging the inclined piston surface from the dogs and allowing the dog springs to push the dogs radially inward away from the mandrel. As discussed above, the microprocessor may shut off the pump when the top of the piston engages the limit switch 1083. The drill string may then be raised from the surface, thereby pulling the housing from the mandrel. To re-connect the housing and the mandrel, the housing may be lowered until the dogs are longitudinally aligned with the threaded portion of the mandrel. A second RFID tag may be pumped/dropped through the drill string, thereby conveying an instruction signal to re-engage the dogs. The microprocessor may then reverse electricity to the pump, thereby reversing the process.

In another alternative embodiment (FIGS. 10I and 10J) of the disconnect 1000*b*, the actuator 1075 may be omitted and the tool may be flipped upside down so that the mandrel 1060 is connected to the drill string 940 and the housing 1055 is connected to the rest of the BHA 920. A top of the piston 1080 (formerly the bottom) may be slightly modified to form a ball seat. In operation, when it desired to release the housing 1055 and the rest of the BHA from the mandrel 1060 and the drill string, the bit may be set on the bottom of the wellbore. A ball (not shown) may be pumped through the drill string by injection of drilling fluid behind the ball and the ball may land on the ball seat. Drilling fluid injection may continue after landing of the ball, thereby increasing pressure in the mandrel bore. Pressure exerted on the ball and piston may move the piston longitudinally against the spring 1078, thereby disengaging the inclined piston surface from the dogs and allowing the dog springs to push the dogs radially inward away from the mandrel. The drill string may then be raised from the surface, thereby pulling the mandrel from the housing.

Figure 11:
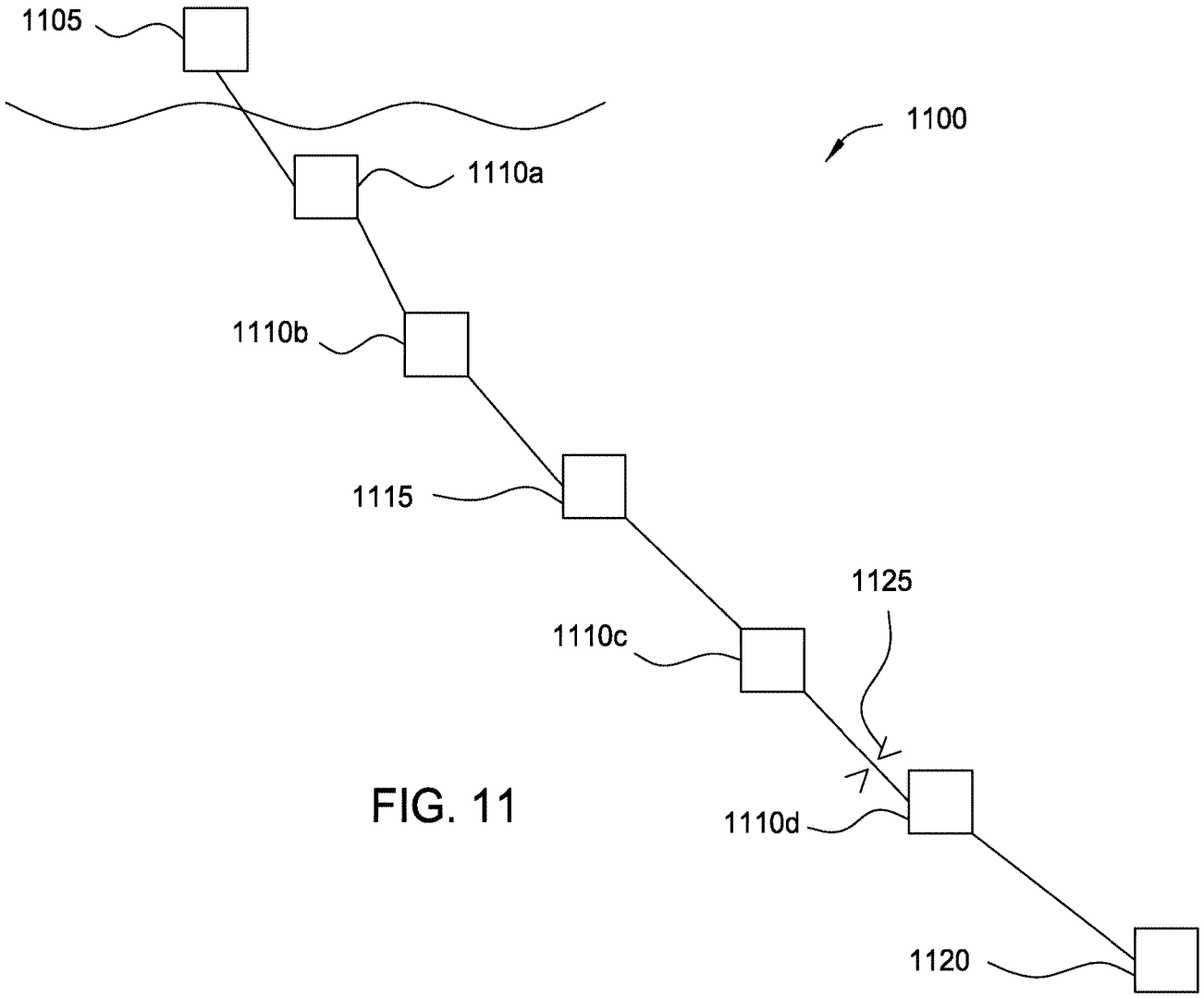
FIG. 11 is a schematic of a drilling assembly, according to another embodiment of the present invention.

FIG. 11 is a schematic of a drilling assembly 1100, according to another embodiment of the present invention. The drilling assembly 1100 may include a drill string and a drill bit 1120 connected to a lower end of the drill string. The drill string may be stuck in the wellbore at 1125. The drilling assembly 1100 may include a plurality of data/repeater subs 1110*a-d* disposed interconnecting segments of the drill string. Instead of deploying a freepoint tool on a wireline to measure the depth of 1125, a freepoint test may be performed. A first RFID tag 350*a,p* may be pumped through the drill string instructing the data subs 1110*a-d* to begin recording data. The drill string may then be placed in torsion and/or tension from the surface. A second RFID tag 350*a,p* may then be pumped through the drill string. The second RFID tag may include a memory unit and instruct the data subs 1110*a-c* to transmit the appropriate torque and/or load measurement to the second tag. When the second tag reaches the bottom data sub 1110*d*, the second tag may transmit the torque and/or load measurements to the bottom data sub and instruct the bottom data sub to transmit all of the torque and/or load measurements to the surface. From the torque and/or load measurements, the surface may determine the depth of 1125.

A string shot may then be deployed to the threaded connection just above the freepoint 1125 to retrieve the free portion of the drill string and then the fishing assembly 500 may be deployed to retrieve the stuck portion of the drill string. Alternatively, the drilling assembly may further include a plurality of disconnects 1105, 1115 and a third tag may be pumped through the drill string to operate the release sub 1115 closest to (and above) the freepoint 1125 and the free portion of the drill string may then be removed. Alternatively, the bottom sub may transmit the data to the second tag and then the second tag may flow to the surface with all of the data.

Figure 12A:
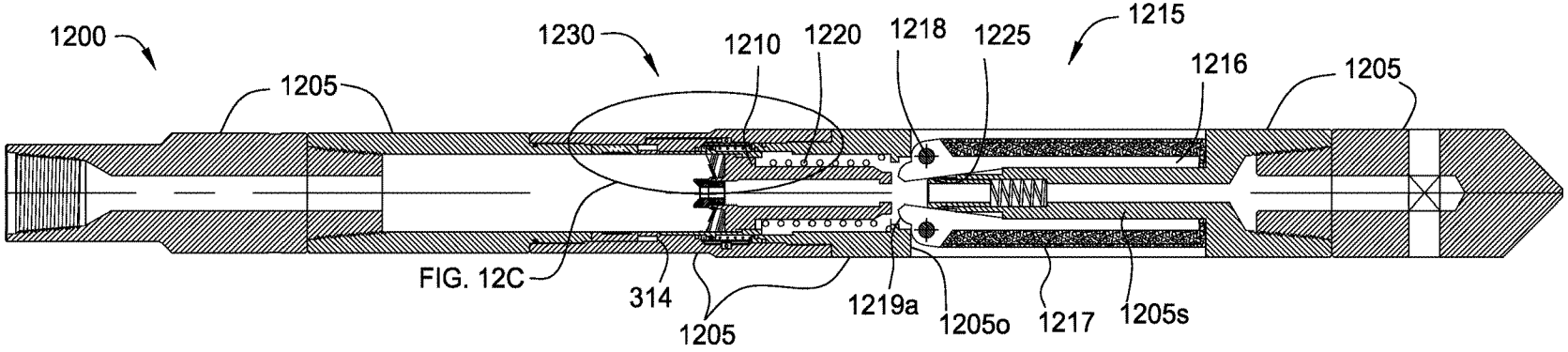
FIG. 12A is a cross section of a casing cutter in a retracted position, according to another embodiment of the present invention.
Figure 12B:
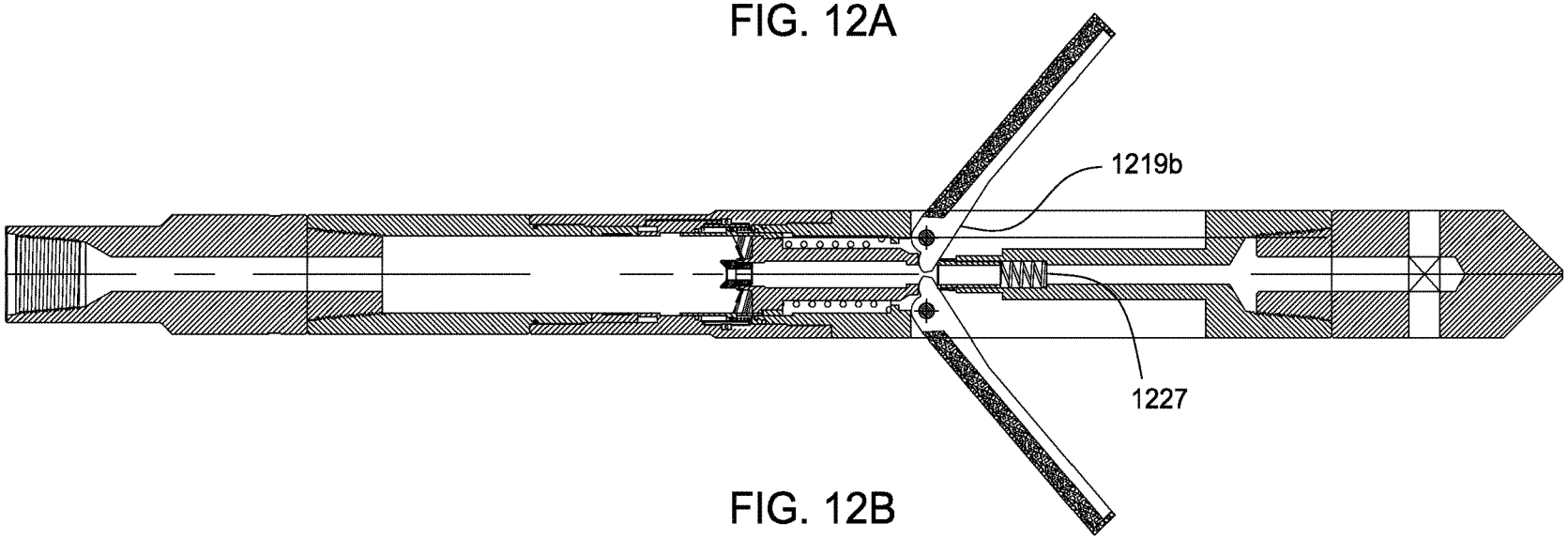
FIG. 12B is a cross section of the casing cutter in an extended position.
Figure 12C:
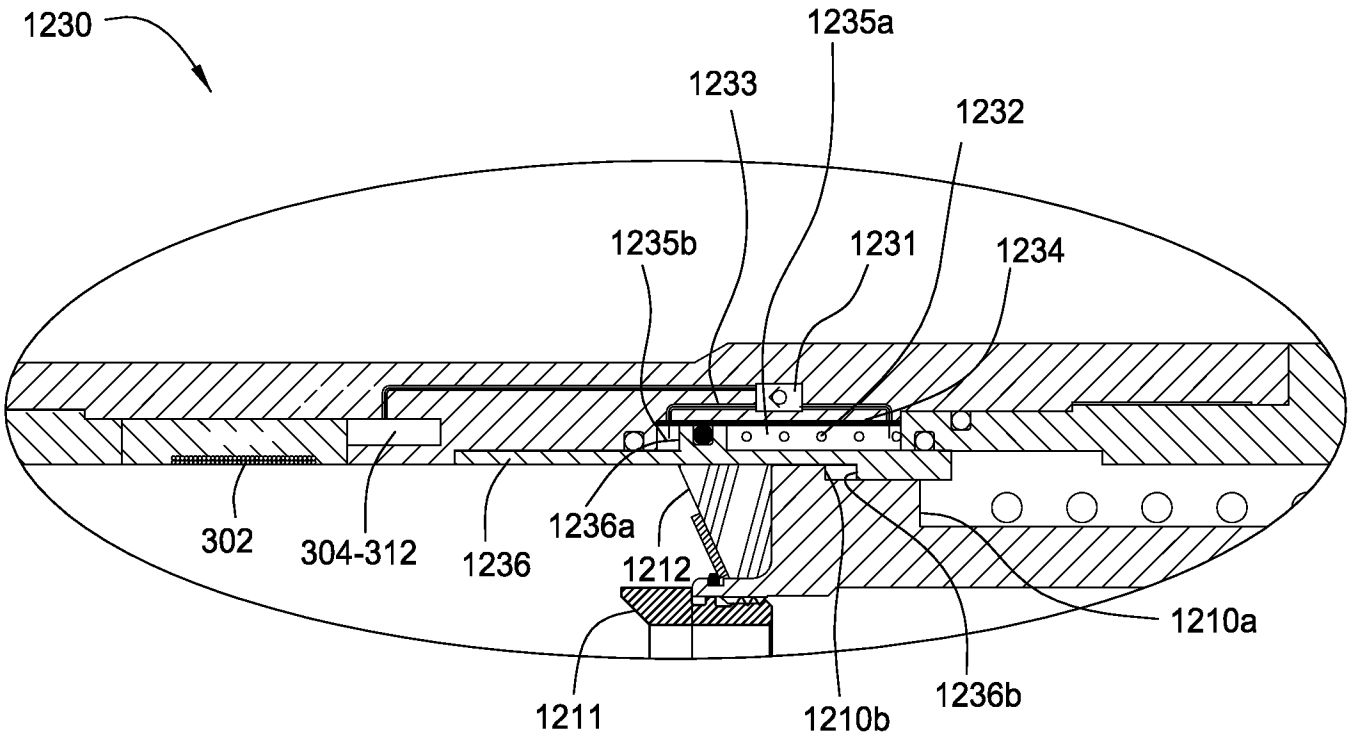
FIG. 12C is an enlargement of a portion of FIG. 12A.

FIG. 12A is a cross section of a casing cutter 1200 in a retracted position, according to another embodiment of the present invention. FIG. 12B is a cross section of the casing cutter 1200 in an extended position. FIG. 12C is an enlargement of a portion of FIG. 12A. The casing cutter 1200 may include a housing 1205, a piston 1210, a seal 1212, a plurality of blades 1215, a piston spring 1220, a follower 1225, a follower spring 1227, and a blade stop 1230. The housing 1205 may be tubular and may have a threaded coupling formed at a longitudinal end thereof for connection to a workstring (not shown) deployed in a wellbore for an abandonment operation. The workstring may be drill pipe or coiled tubing. To facilitate manufacture and assembly, the housing 1205 may include a plurality of longitudinal sections, each section longitudinally and rotationally coupled, such as by threaded connections, and sealed (above the piston 1210), such as by O-rings.

Each blade 1215 may include an arm 1216 pivoted 1218 to the housing for rotation relative to the housing between a retracted position and an extended position. A coating 1217 of hard material, such as tungsten carbide, may be bonded to an outer surface and a bottom of each arm 1216. The hard material may be coated as grit. A top surface of each arm may form a cam 1219*a* and an inner surface of each arm may form a taper 1219*b*. The housing 1205 may have an opening 1205*o* formed therethrough for each blade. Each blade 1215 may extend through a respective opening 1205*o* in the extended position.

The piston 1210 may be tubular, disposed in a bore of the housing, and include a main shoulder 1210*a*. The piston spring 1220 may be disposed between the main shoulder 1210*a* and a shoulder formed in an inner surface of the housing, thereby longitudinally biasing the piston 1210 away from the blades 1215. A nozzle 1211 may be longitudinally coupled to the piston 1210, such as by a threaded connection, and made from a erosion resistant material, such as tungsten carbide. To extend the blades 1215, drilling fluid may be pumped through the workstring to the housing bore. The drilling fluid may then continue through the nozzle 1211. Flow restriction through the nozzle 1211 causes pressure loss so that a greater pressure is exerted on a top of the piston 1210 than on the main shoulder 1210*a*, thereby longitudinally moving the piston downward toward the blades and against the piston spring 1220. As the piston 1210 moves downward, a bottom of the piston 1210 engages the cam surface 1219*a* of each arm 1216, thereby rotating the blades 1215 about the pivot 1218 to the extended position.

The housing 1205 may have a stem 1205*s* extending between the blades 1215. The follower 1225 may extend into a bore of the stem 1205*s*. The follower spring 1227 may be disposed between a bottom of the follower and a shoulder of the stem 1205*s*. The follower 1225 may include a profiled top mating with each arm taper 1219*b* so that longitudinal movement of the follower toward the blades 1215 radially moves the blades toward the retracted position and vice versa. The follower spring 1227 may longitudinally bias the follower 1225 toward the blades 1215, thereby also biasing the blades toward the retracted position. When flow through the housing 1205 is halted, the piston spring 1220 may move the piston 1210 upward away from the blades 1215 and the follower spring 1227 may push the follower 1225 along the taper 1219*b*, thereby retracting the blades.

The blade stop 1230 may include the electronics package 300, a solenoid valve 1231, a stop spring 1232, a flow passage 1233, a position sensor 1234, chambers 1235*a,b*, and a sleeve 1236. The chambers 1235*a,b* may be filled with a hydraulic fluid, such as oil. The first chamber 1235*a* may be formed radially between an inner surface of the housing 1205 and an outer surface of the sleeve 1236 and longitudinally between a bottom of a first shoulder 1236*a* of the sleeve and a top of one of the housing sections. The second chamber 1235*b* may be formed radially between an inner surface of the housing 1205 and an outer surface of the sleeve 1236 and longitudinally between a top of the first shoulder 1236*a* and a shoulder of the housing. As discussed above, the position sensor 1234 may measure a position of the first shoulder 1236*a* and communicate the position to the microprocessor 310. The solenoid operated valve 1231 may be a check valve operable between a closed position where the valve functions as a check valve oriented to prevent flow from the first chamber to the second chamber (downward flow) and allow reverse flow therethrough, thereby fluidly stopping downward movement of the sleeve 1236. The sleeve 1236 may further include a second shoulder 1236*b* and the piston may include a stop shoulder 1210*b*. Engagement of the stop shoulder 1210*b* with the second shoulder 1236*b* also stops downward movement of the piston, thereby limiting extension of the blades 1215.

In operation, when it is desired to activate the cutter 1200, a tag 350*a,p* may be pumped/dropped through the workstring to the antenna 302, thereby conveying an blade setting instruction signal. Drilling fluid may then be circulated through the workstring from the surface to extend the blades 1215. The microprocessor 310 may monitor the position of the sleeve 1236 until the sleeve reaches a position corresponding to the set position of the blades 1215. The microprocessor 310 may then supply electricity from the battery 314 to the solenoid valve 1231, thereby closing the solenoid valve and halting downward movement of the sleeve 1236 and extension of the blades 1215. The workstring may then be rotated, cutting through a wall of a casing string to be removed from the wellbore. Once the casing string has been cut, the casing cutter 1200 may be redeployed in the same trip to cut a second casing string having a different diameter by dropping a second tag having a second blade setting instruction.

Additionally, the blade stop may serve as a lock to prevent premature actuation of the blades. Alternatively, the first blade setting may be preprogrammed at the surface.

Figure 12D:
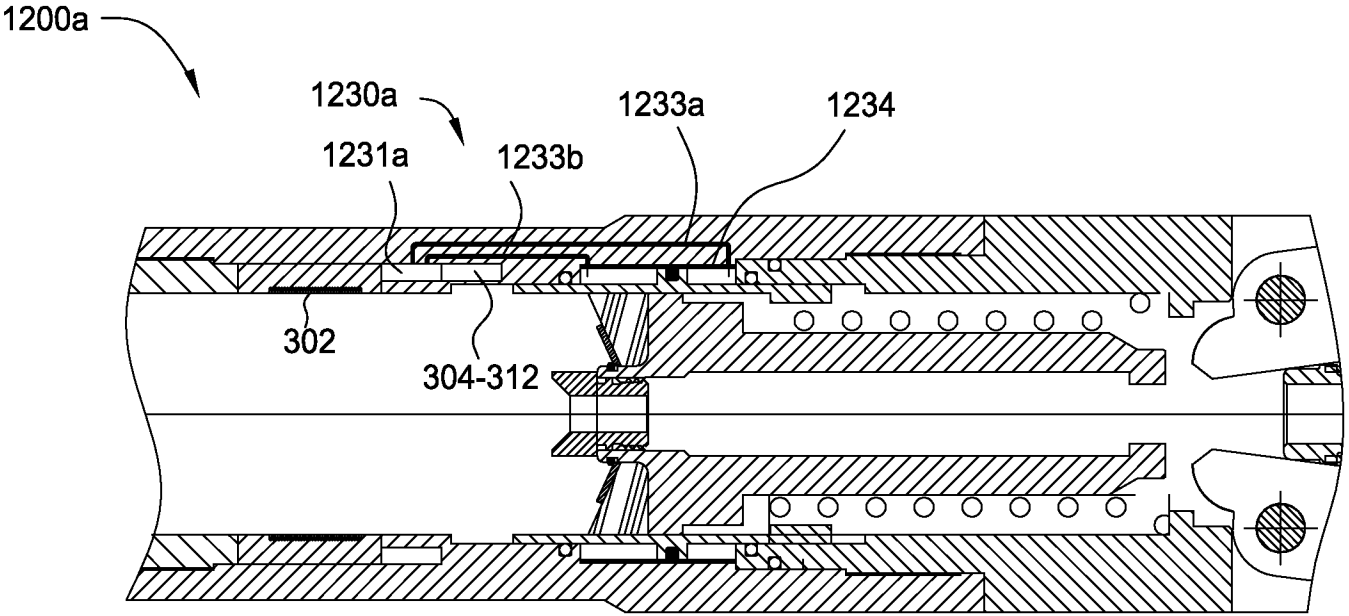
FIG. 12D is a cross section of a portion of an alternative casing cutter including an alternative blade stop in a retracted position.

FIG. 12D is a cross section of a portion of an alternative casing cutter 1200*a* including an alternative blade stop 1230*a* in a retracted position. Instead of the solenoid valve, the alternative blade stop may include a pump 1231*a* in communication with each of the chambers 1235*a, b* via passages 1233*a, b*. The sleeve may be moved to the set position by supplying electricity to the pump and then shutting the pump off when the sleeve is in the set position as detected by the position sensor 1234.

Figure 12E:
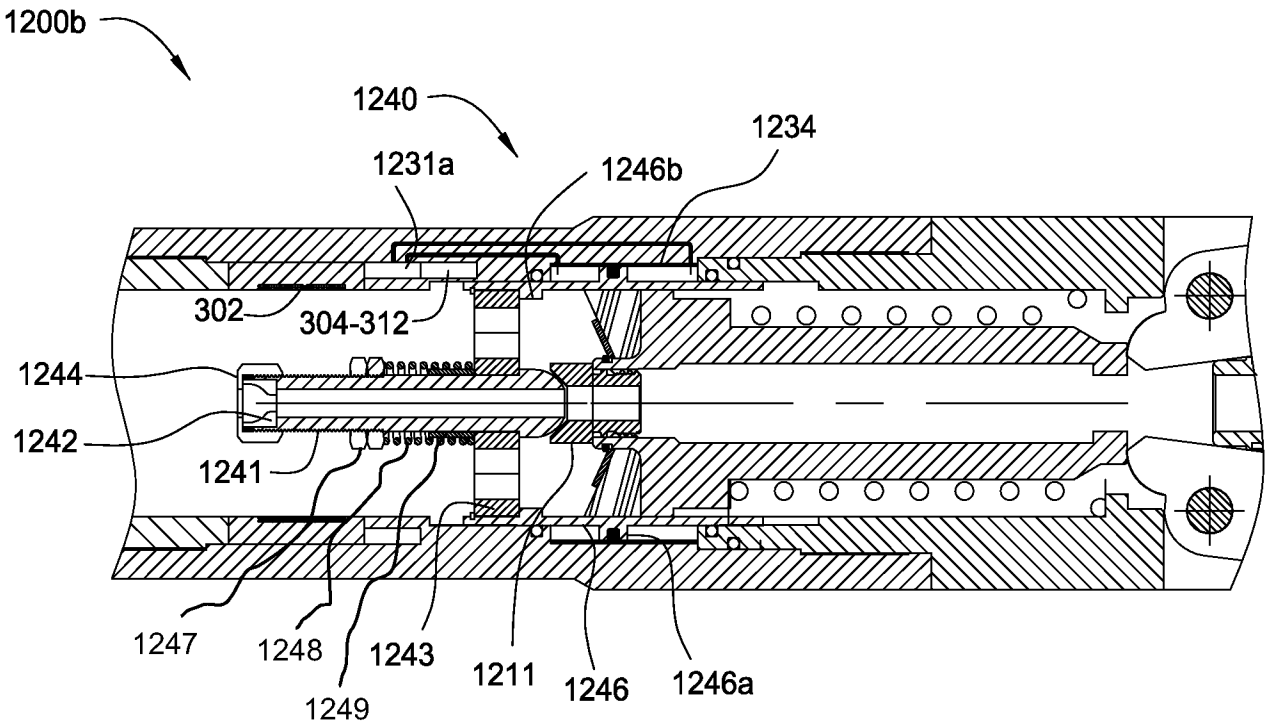
FIG. 12E is a cross section of a portion of an alternative casing cutter including a position indicator instead of a blade stop.

FIG. 12E is a cross section of a portion of an alternative casing cutter 1200*b* including a position indicator 1240 instead of a blade stop 1230. The position indicator 1240 may include the electronics package 300, a body 1241, a nozzle 1242, a flange 1243, the pump 1231*a*, and a sleeve 1246. The body 1241 may include a nose formed at a bottom thereof for seating against the nozzle 1211. The nozzle 1242 may be longitudinally coupled to the body 1241 via a threaded cap 1244. The flange 1243 may be biased toward a shoulder formed in an outer surface of the body 1241 by a spring 1248. The spring 1248 may be disposed between the body 1241 and one or more threaded nuts 1247 engaging a threaded outer surface of the body. The flange 1243 may be longitudinally coupled to the sleeve 1246 by abutment with a second shoulder 1246*b* of the sleeve and abutment with a fastener, such as a snap ring. The flange 1243 may have one or ports formed therethrough. The sleeve 1246 may also have a first shoulder 1246*a*. The body 1241 may be longitudinally movable downward toward the nozzle 1211 relative to the flange 1243 by a predetermined amount adjustable at the surface by the nuts 1247.

During normal operation in the extended position, the body nose may be maintained against the nozzle 1211. Drilling fluid may be pumped through both nozzles 1242, 1211, thereby extending the blades. As the piston 1210 moves downward toward the blades 1215, fluid pressure exerted on the body 1241 by restriction through the nozzle 1242 may push the body 1241 longitudinally toward the piston 1210, thereby maintaining engagement of the body nose and the nozzle 1211. If the blades 1215 extend past a desired cutting diameter, the nuts 1247 abut the stop 1249, thereby preventing the body nose from following the nozzle 1211. Separation of the blade nose from the nozzle 1211 allows fluid flow to bypass the nozzle 1242 via the flange ports, thereby creating a pressure differential detectable at the surface. To initialize or change the setting of the sleeve 1246, a tag may be pumped to the antenna 302, thereby conveying the setting to the microprocessor 310. The microprocessor 310 may move the sleeve 1246 to the setting using the pump 1231*a*, thereby also moving the body 1241.

Figure 12F:
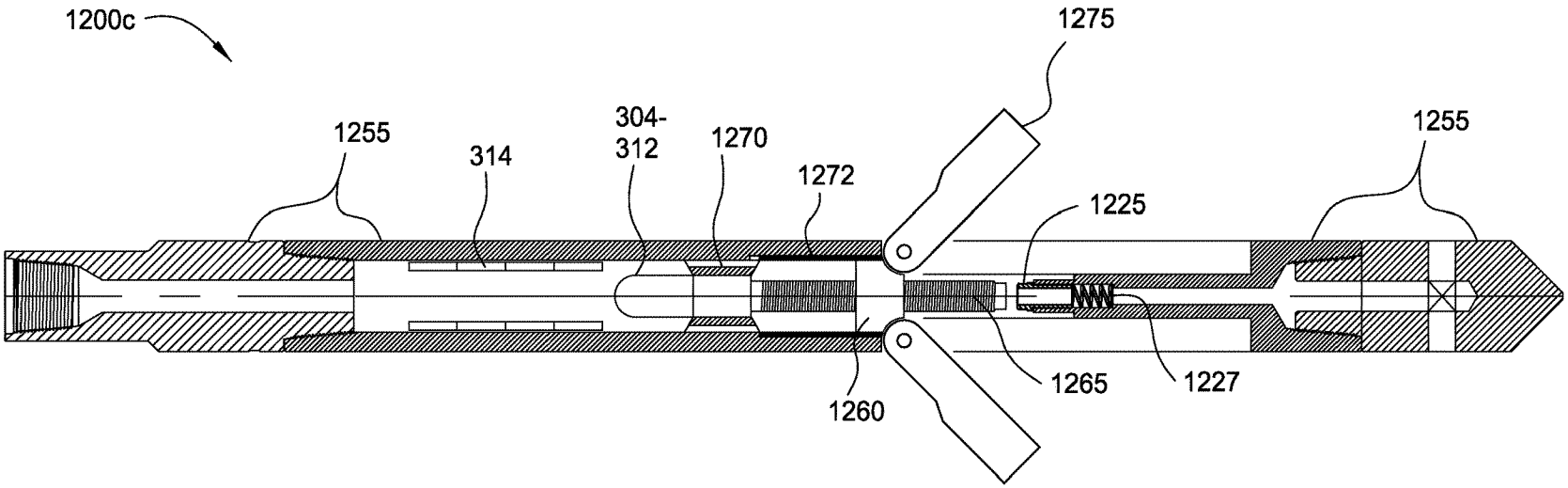
FIG. 12F is a cross section of an alternative casing cutter in an extended position.

FIG. 12F is a cross section of an alternative casing cutter 1200*c* in an extended position. The casing cutter may include a housing 1255, a plurality of blades 1275, a follower 1225, a follower spring 1227, and a blade actuator. The housing 1255 may be tubular and may have a threaded coupling formed at a longitudinal end thereof for connection to a workstring (not shown) deployed in a wellbore for an abandonment operation. The workstring may be drill pipe or coiled tubing. To facilitate manufacture and assembly, the housing 1255 may include a plurality of longitudinal sections, each section longitudinally and rotationally coupled, such as by threaded connections, and sealed (above the blades 1275), such as by O-rings. Although shown schematically, the blades 1275 may be similar to the blades 1215 and may be returned to the retracted position by the follower 1225 and the follower spring 1227.

The actuator may include the electronics package 300, a cam 1260, a shaft 1265, an electric motor 1270, and a position sensor 1272. The shaft 1265 may be longitudinally and rotationally coupled to the motor 1270. The shaft 1265 may include a threaded outer surface. The cam 1260 may be disposed along the shaft 1265 and include a threaded inner surface (not shown). The cam 1260 may be moved longitudinally along the shaft by rotation of the shaft 1265 by the motor 1270. As discussed above, the microprocessor may measure the longitudinal position of the cam 1265 and the position of the blades 1270 using the position sensor 1272. The motor 1270 may further include a lock to hold the blades in the set position. Although shown schematically, as the cam 1260 moves downward, a bottom of the cam engages a cam surface of each blade 1275, thereby rotating the blades about the pivot to the extended position. The actuator may further include a load cell (not shown) operable to measure a cutting force exerted on the blades 1275 and the microprocessor 310 may be programmed to control the blade position to maintain a constant predetermined cutting force. The actuator may further include a mud pulser to send a signal to the surface when the cut is finished or if the cutting forces exceed a predetermined maximum.

In operation, when it is desired to activate the cutter 1200*c*, a tag 350*a,p* may be pumped/dropped through the workstring to the antenna 302, thereby conveying an blade setting instruction signal. The microprocessor 310 may supply electricity to the motor 1270 and monitor the position of the blades 1275 until the set position is reached. The microprocessor 310 may shut off the motor (which may also set the lock). Drilling fluid may then be circulated through the workstring from the surface and the workstring may then be rotated, thereby cutting through a wall of a casing string to be removed from the wellbore. Once the casing string has been cut, a second tag may be pumped/dropped to the antenna, thereby conveying an instruction signal to retract the blades. Alternatively, the blades may automatically retract when the cut is finished. The microprocessor 310 may supply reversed polarity electricity to the motor 1270, thereby unsetting the lock and moving the cam away from the blades so that the follower 1225 may retract the blades. The casing cutter 1200*c* may be redeployed in the same trip to cut a second casing string having a different diameter by dropping a third tag having a second blade setting instruction.

Figure 13A:
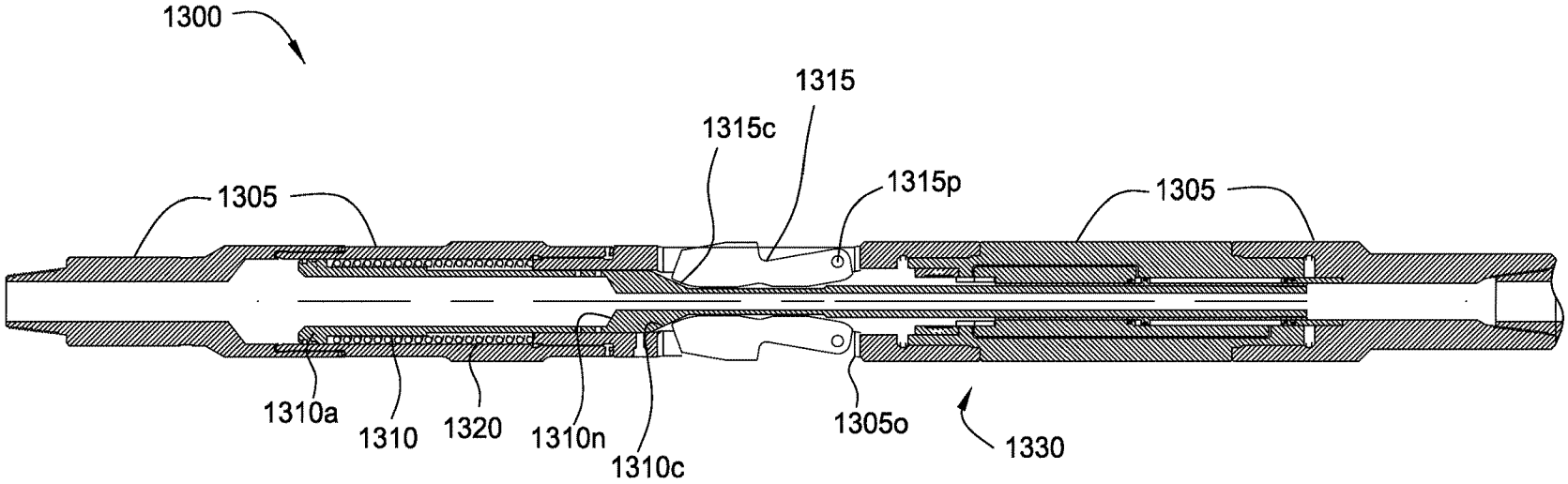
FIG. 13A is a cross section of a section mill 1300 in a retracted position, according to another embodiment of the present invention.
Figure 13B:
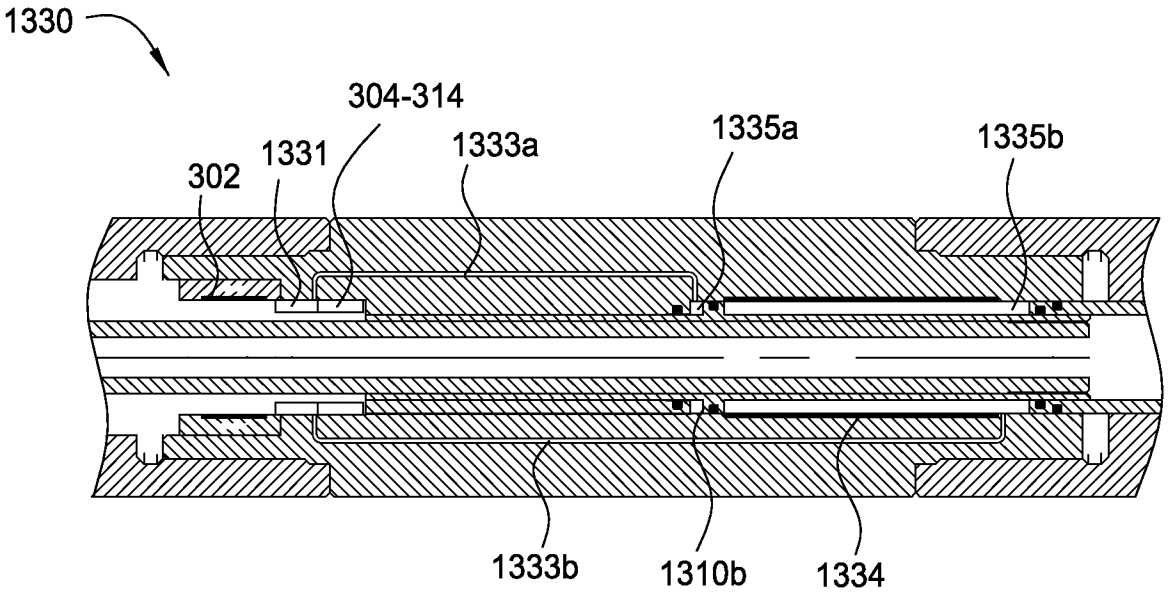
FIG. 13B is an enlargement of a portion of FIG. 13A.

FIG. 13A is a cross section of a section mill 1300 in a retracted position, according to another embodiment of the present invention. FIG. 13B is an enlargement of a portion of FIG. 13A. The section mill may include a housing 1305, a piston 1310, a plurality of blades 1315, a piston spring 1320, and a blade actuator 1330. The housing 1305 may be tubular and may have a threaded couplings formed at longitudinal ends thereof for connection to a workstring (not shown) deployed in a wellbore for a milling operation. The workstring may be drill pipe or coiled tubing. To facilitate manufacture and assembly, each of the housing 1305 and the piston 1310 may include a plurality of longitudinal sections, each section longitudinally and rotationally coupled, such as by threaded connections.

Each blade 1315 may be pivoted 1315*p* to the housing 1305 for rotation relative to the housing between a retracted position and an extended position. Each blade 1315 may include a coating (not shown) of hard material, such as tungsten carbide, bonded to an outer surface and a bottom thereof. The hard material may be coated as grit. An inner surface of each blade may be cammed 1315*c*. The housing may have an opening 1305*o* formed therethrough for each blade 1315. Each blade 1315 may extend through a respective opening 1305*o* in the extended position.

The piston 1310 may be tubular, disposed in a bore of the housing 1305, and include one or more shoulders 1310*a,b*. The piston spring 1320 may be disposed between the first shoulder 1310*a* and a shoulder formed by a top of one of the housing sections, thereby longitudinally biasing the piston 1310 away from the blades 1315. The piston 1310 may have a nozzle 1310*n*. As a backup to the actuator 1330, to extend the blades, drilling fluid may be pumped through the workstring to the housing bore. The drilling fluid may then continue through the nozzle 1310*n*. Flow restriction through the nozzle may cause pressure loss so that a greater pressure is exerted on the nozzle 1310*n* than on a cammed surface 1310*c* of the piston 1310*c*, thereby longitudinally moving the piston downward toward the blades and against the piston spring. As the piston 1310 moves downward, the cammed surface 1310*c* engages the cam surface 1315*c* of each blade 1315, thereby rotating the blades about the pivot 1315*p* to the extended position.

The blade actuator 1330 may include the electronics package 300, an electric pump 1331, flow passages 1333*a, b*, chambers 1335*a, b*, the second piston shoulder 1310*b*, and a position sensor 1334. The chambers 1335*a, b* may be filled with a hydraulic fluid, such as oil. The first chamber 1335*a* may be formed radially between an inner surface of the housing 1305 and an outer surface of the piston 1310 and longitudinally between a bottom of the shoulder 1310*b* and a top of one of the housing sections. The second chamber 1335*b* may be formed radially between an inner surface of the housing 1305 and an outer surface of the sleeve and longitudinally between a top of the shoulder 1310*b* and a shoulder of the housing. The pump 1331 may be in fluid communication with each of the chambers 1335*a, b* via a respective passage 1333*a, b*.

In operation, when it is desired to activate the mill 1300, an RFID tag 350*a,p* may be pumped/dropped through the workstring to the antenna 302, thereby conveying an instruction signal to extend the blades 1315. The microprocessor 310 may supply electricity to the pump 1331, thereby pumping fluid from the chamber 1335*b* to the chamber 1335*a* and forcing the piston 1310 to move longitudinally downward and extending the blades 1315. As with the casing cutter, the tag may include a position setting instruction so that the microprocessor may actuate the piston to the instructed set position which may be fully extended, partially extended, or substantially extended depending on the diameter of the casing/liner section to be milled. As discussed above, the microprocessor may monitor the position of the 1310 and the blades using the position sensor 1334. Drilling fluid may then be circulated and the workstring may then be rotated and raised/lowered until a desired section of casing or liner has been removed. Once the casing/liner has been milled, the mill may be retracted by pumping/dropping a second tag, thereby conveying an instruction signal to retract the blades. The microprocessor may then reverse operation of the pump. Alternatively, the actuator may include a motor instead of a pump in which case the piston may be a mandrel.

Alternatively, the blade actuator 1330 may be used with the casing cutter 1200 and either of the blade stops 1230 may be used with the section mill 1300.

Figure 13C:
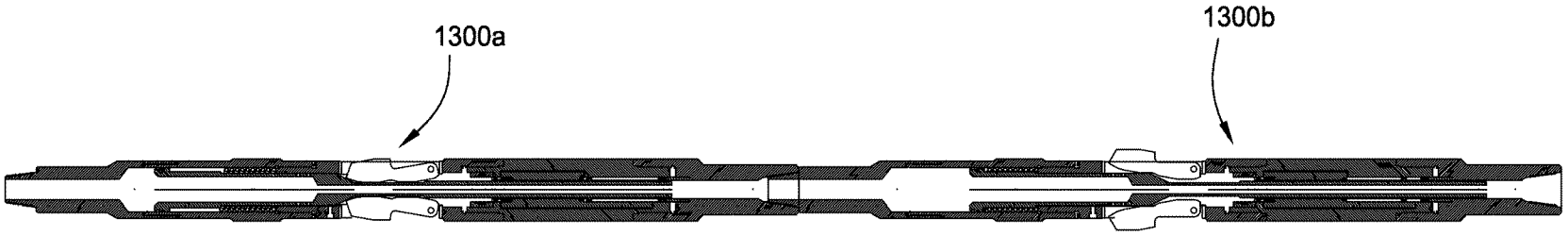
FIG. 13C illustrates two section mills connected, according to another embodiment of the present invention.

FIG. 13C illustrates two section mills 1300*a, b* connected, according to another embodiment of the present invention. The primary section mill 1300*b* has been extended and is ready to mill a section of casing/liner. Once the blades of the primary mill become worn, the backup mill 1300*a* may be extended by dropping/pumping a tag down, thereby conveying an instruction signal to the primary mill 1300*b* to retract the blades and for the backup mill to extend the blades. The milling operation may then continue without having to remove the primary mill to the surface for repair. Alternatively, two casing cutters 1200 may be deployed in a similar fashion.

Alternatively, any of the actuators discussed herein may be used with any of the tools discussed herein.

While the foregoing is directed to embodiments of the present invention, other and further embodiments of the invention may be devised without departing from the basic scope thereof, and the scope thereof is determined by the claims that follow.

The invention claimed is:

1. A tool for cutting or milling a tubular cemented to a wellbore, comprising:

a tubular housing having a plurality of openings formed through a wall thereof;

a plurality of blades movable relative to the housing between an extended position and a retracted position, each blade extending through a respective opening in the extended position;

a piston disposed in the housing and operable to move the blades to the extended position in response to injection of fluid therethrough;

a blade stop, comprising:

a receiver operable to receive an instruction signal;

a sleeve disposed between the tubular housing and the piston and operable to limit the axial movement of the piston relative to the housing;

a lock operable to lock the sleeve in a position; and a controller in communication with the receiver and the lock, and operable to activate the lock in response to the instruction signal, thereby limiting axial movement of the piston relative to the housing.

2. The tool of claim 1, wherein:

the blade stop further comprises a position sensor, and the controller is further operable to activate the lock to lock the sleeve at the position included in the instruction signal.

3. The tool of claim 1, wherein the receiver comprises an antenna located adjacent to a flow bore of the tool and operable to receive the instruction signal from a radio frequency identification (RFID) tag travelling through the flow bore.

4. The tool of claim 1, the sleeve having a first shoulder; and the blade stop further comprising:

a first chamber formed radially between an inner surface of the tubular housing and an outer surface of the sleeve and longitudinally between a first side of the first shoulder of the sleeve and the housing;

a second chamber formed radially between the inner surface of the housing and the outer surface of the sleeve and longitudinally between a second side of the first shoulder and the housing; and a passage disposed between the first chamber and the second chamber providing fluid communication therebetween, wherein the lock is disposed in the passage.

5. The tool of claim 4, wherein the lock is at least one of a solenoid valve or a pump.

6. The tool of claim 4, wherein a seal is disposed between the first shoulder of the sleeve and the housing.

7. The tool of claim 4, wherein:

the sleeve having a second shoulder;

the piston having a stop shoulder; and wherein engagement of the stop shoulder with the second shoulder limits the axial movement of the piston relative to the tubular housing.

8. The tool of claim 1, wherein the receiver is operable to receive an second instruction signal, and the controller is operable to release the lock in response to the second instruction signal and to re-activate the lock to lock the sleeve at the position included in the second instruction signal.

9. The tool of claim 1, wherein the piston further comprises a nozzle.

10. The tool of claim 1, further comprising:

the piston having a piston shoulder with a first and a second side; and an actuator operable to move the piston having:

a first hydraulic chamber formed between the tubular housing and the piston, the first hydraulic chamber extending longitudinally between the first side of the piston shoulder and the housing;

a second hydraulic chamber formed between the tubular housing and the piston, the second hydraulic chamber extending longitudinally between the second side of the piston shoulder and the housing;

at least one passage providing fluid communication between the first and second hydraulic chambers;

an pump disposed in the at least one passage; and a controller operable to activate the pump.

11. A tool for cutting or milling a tubular cemented to a wellbore, comprising:

a tubular housing having a plurality of openings formed through a wall thereof;

a plurality of blades movable relative to the housing between an extended position and a retracted position, each blade extending through a respective opening in the extended position;

a piston disposed in the housing and operable to move the blades to the extended position in response to injection of fluid therethrough;

a sleeve disposed between the tubular housing and the piston;

a lock operable to lock the sleeve in a position; and a controller in communication with a receiver and the lock, and operable to activate the lock in response to an instruction signal.

12. The tool of claim 11, wherein the sleeve is operable to limit the axial movement of the piston relative to the housing.

13. The tool of claim 11, wherein the piston further comprises a nozzle.

14. The tool of claim 13, further comprising:

a position indicator disposed in the tubular housing including:

a body having a bore therethrough and axially movable relative to the tubular housing, the body having a nose at a first end and a nozzle at a second end and a body stop disposed therebetween, wherein the nose is configured to seat against the nozzle of the piston;

a flange coupled to the body and axially movable relative to the tubular housing, the flange having at least one port and a flange stop, wherein the body is axially movable relative to the flange, and wherein the flange is longitudinally coupled to the sleeve;

a biasing member between the body stop and the flange stop; and wherein engagement of the body stop with the flange stop limits the axial movement of the body relative to the tubular housing.

15. The tool of claim 14, wherein the sleeve is operable to limit the axial movement of the flange relative to the tubular housing.

16. The tool of claim 11, wherein the piston further comprises a cam surface and each blade further comprises a cam surface, wherein the cam surface of the piston engages with the cam surface of each blade, thereby moving the blade to the extended position.

17. The tool of claim 16, further comprising a follower biasing the blades in the retracted position, the follower having a profile that engages with a taper of the blade.

18. The tool of claim 11, wherein the lock is at least one of a solenoid valve or a pump.

19. The tool of claim 11, further comprising:

the piston having a piston shoulder with a first and second side; and an actuator operable to move the piston having:

a first hydraulic chamber formed between the tubular housing and the piston, the first hydraulic chamber extending longitudinally between the first side of the piston shoulder and the housing;

a second hydraulic chamber formed between the tubular housing and the piston, the second hydraulic chamber extending longitudinally between the second side of the piston shoulder and the housing;

at least one passage providing fluid communication between the first and second hydraulic chambers;

an pump disposed in the at least one passage; and a controller operable to activate the pump.

20. A tool for cutting or milling a tubular cemented to a wellbore, comprising:

a tubular housing having a plurality of openings formed through a wall thereof;

a plurality of blades movable relative to the housing between an extended position and a retracted position, each blade extending through a respective opening in the extended position;

a piston disposed in the housing and operable to move the blades to the extended position, the piston having a shoulder with a first and second side;

an actuator operable to move the piston in response to an instruction signal, comprising:

a receiver operable to receive the instruction signal;

a first hydraulic chamber formed between the tubular housing and the piston, the first hydraulic chamber extending longitudinally between the first side of the piston shoulder and the housing;

a second hydraulic chamber formed between the tubular housing and the piston, the second hydraulic chamber extending longitudinally between the second side of the piston shoulder and the housing;

at least one passage providing fluid communication between the first and second hydraulic chambers;

a pump disposed in the at least one passage and operable to move hydraulic fluid from one hydraulic chamber to the other hydraulic chamber; and a controller in communication with the receiver and operable to activate the pump in response to the instruction signal.

* * * * *